US007029004B2

(12) United States Patent
Asada et al.

(10) Patent No.: US 7,029,004 B2
(45) Date of Patent: Apr. 18, 2006

(54) SHEET-SUPPLY DEVICE AND IMAGE FORMING DEVICE INCLUDING SAME

(75) Inventors: Tetsuo Asada, Kuwana (JP); Koji Takito, Nisshin (JP); Takatoshi Takemoto, Nagoya (JP); Hiroshi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 170 days.

(21) Appl. No.: 10/390,825

(22) Filed: Mar. 19, 2003

(65) Prior Publication Data

US 2003/0184003 A1 Oct. 2, 2003

(30) Foreign Application Priority Data

Mar. 29, 2002 (JP) ..... 2002-094503
Jul. 23, 2002 (JP) ..... 2002-213367

(51) Int. Cl.
*B65H 3/52* (2006.01)

(52) U.S. Cl. ..... 271/121; 271/127; 271/124
(58) Field of Classification Search ..... 271/127, 271/121, 124
See application file for complete search history.

(56) References Cited

U.S. PATENT DOCUMENTS

| | | | | |
|---|---|---|---|---|
| 5,971,310 | A * | 10/1999 | Saliba et al. | 242/332.4 |
| 5,971,390 | A | 10/1999 | Caspar et al. | |
| 6,199,855 | B1 | 3/2001 | Choeng et al. | |
| 6,308,947 | B1 * | 10/2001 | Kojima et al. | 271/124 |
| 6,382,621 | B1 | 5/2002 | Inoue et al. | |
| 6,416,050 | B1 * | 7/2002 | Niikura | 271/127 |
| 2002/0054381 | A1 | 5/2002 | Iwase | |
| 2002/0060396 | A1 | 5/2002 | Tanaka | |
| 2002/0070495 | A1 * | 6/2002 | Takeuchi | 271/121 |
| 2004/0017039 | A1 | 1/2004 | Asada et al. | |

FOREIGN PATENT DOCUMENTS

| | | |
|---|---|---|
| EP | 0 792 827 A2 | 9/1997 |
| FR | 2 813 820 | 3/2002 |
| JP | 08-091589 | 4/1996 |
| JP | 2000-143023 | 5/2000 |
| JP | 2000-168980 | 6/2000 |
| JP | 2001-088951 | 4/2001 |
| JP | A 2001-106367 | 4/2001 |
| JP | 2001-302006 | 10/2001 |
| JP | A 2002-60068 | 2/2002 |
| JP | 2002-503605 | 2/2002 |
| JP | 2002-068484 | 3/2002 |

OTHER PUBLICATIONS

U.S. Appl. No. 10/619,674, Asada et al., filed Jul. 16, 2003.

* cited by examiner

*Primary Examiner*—Donald P. Walsh
*Assistant Examiner*—Kaitlin Joerger
(74) *Attorney, Agent, or Firm*—Oliff & Berridge, PLC

(57) ABSTRACT

At the lower end of a sheet-supporting surface, there is provided a fixed separation plate from and into the upper surface of which a separating device elongated in the sheet feed direction can protrude and retract. On either side thereof, there are provided first movable separation plates that can be inclined below the fixed separation plate. Stopper members are urged by an urging spring so as to pivot to a position below the supper surfaces of the first movable separation plates. When a pivoting operation lever is rotated, an operation arm is pressed by a cam mounted to an operation shaft through an operating portion, a second link, and a first link to upwardly rotate the stopper members, raising the lower edges of the stacked sheets above the upper surfaces of the separation plates to maintain the stacked set state.

19 Claims, 22 Drawing Sheets

FIG.20C
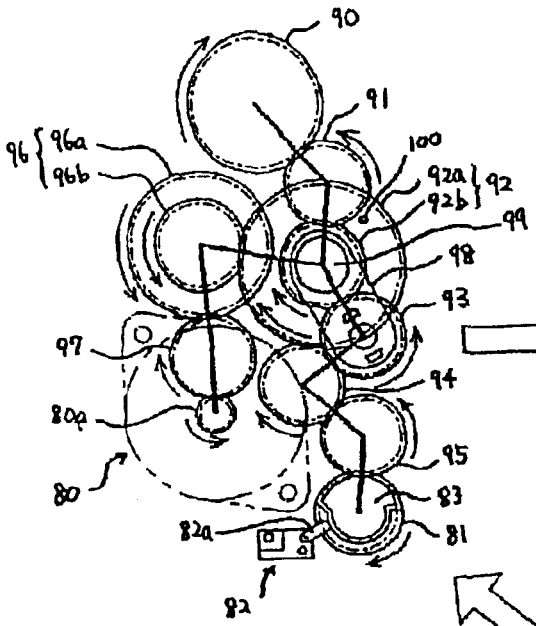
FIG.20A
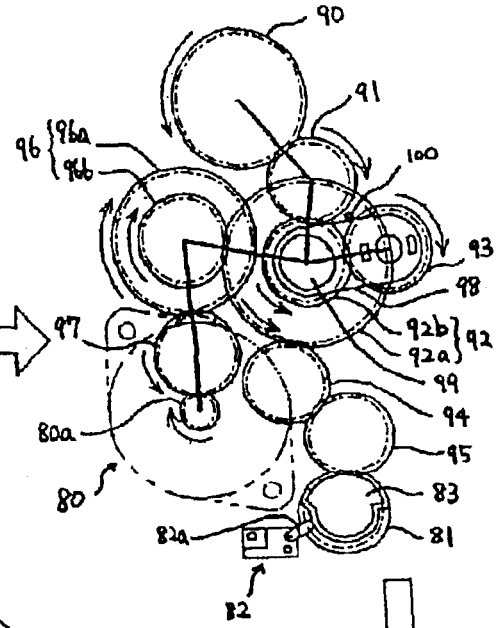
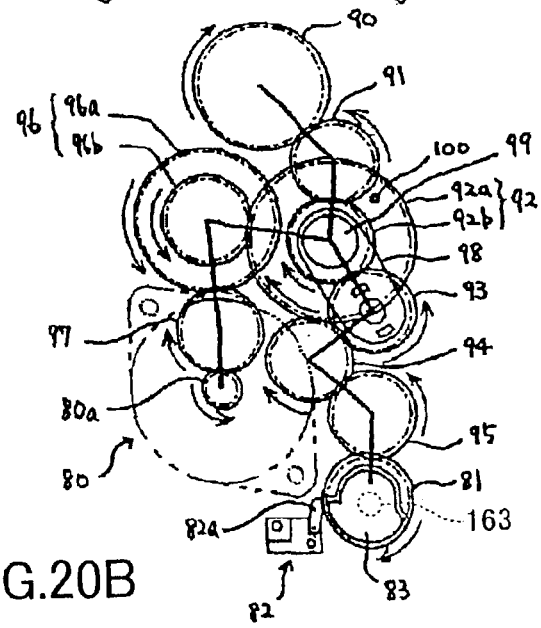
FIG.20B

SHEET-SUPPLY DEVICE AND IMAGE FORMING DEVICE INCLUDING SAME

BACKGROUND OF THE INVENTION

1. Field of the Invention

The present invention relates to a sheet-supply device and an image forming device including the sheet-supply device.

2. Description of the Related Art

Recently, image forming devices such as laser printers, color ink jet printers, facsimile machines, and copy machines, are provided with a sheet-supply device that supplies one cut sheet at a time to an image forming section of the image forming device. Japanese Patent Application Publication Nos. 2001-106367 and 2002-60068 disclose sheet-supply devices that include a slanting tray plate, a separation plate, and a sheet-supply roller. A plurality of sheets is stacked on the tray plate. The sheet-supply roller is provided in confrontation with the tray plate and rotates to supply sheets downstream in a sheet-supply direction. The separation plate is disposed downstream from the tray plate in the sheet-supply direction. The separation plate has a separation slanted surface that extends in a direction that forms an obtuse angle with respect to the surface of the tray plate.

The sheet feed roller is in pressing contact with the uppermost sheet of the sheets stacked on the slanting tray plate. When the sheet feed roller is driven to rotate and a sheet is transported downward, the lower edge of the transported sheet abuts the separation plate, which intersects the sheet transport direction. The sheet advances with its lower end portion toward the guide direction until the sheet lower edge separates from the separation plate. In this way, single sheets can be separated from the sheet stack. The separated sheet is sent to an image forming portion of the image forming device by transport rollers disposed along the guide direction. After image forming portion forms and image on the sheet, the sheet is discharged from the image forming device.

It is preferable for the sheets stacked on the slanting tray plate to be supported with their lower edges abutting against the separation plate. Therefore, the separation plate is usually oriented with its upper surface (sheet abutting surface) flush with horizontal or tilted slightly so that the downstream end (with respect to the guide direction) is slightly above horizontal.

The sheet separation mechanism of a conventional sheet-supply device provides accurate separation during sheet feed. However, the load applied to the separation plate by the stacked sheets can vary. When too many sheets are stacked on the separation plate, the load on the separation plate can increase to the point that the sheets slide downstream across the surface the separation plate all at once. Further, when pliable sheets are set on the slanting tray plate, the sheets can bend so that their lower edges abut the separation plate at an acute angle of, for example, approximately 60 degrees, rather than a substantially 90 degree angle with provides better stability. In such a case, due to their pliability, a large number of sheets can slip over the separation plate to slide downstream all at once. If sheets slide together in this manner, it becomes impossible to support the sheets at a desired position, with a desired posture, and the like. Therefore, sheets do not reliably receive the separating action of the high-friction separation member, resulting in double feeding of sheets. This problem also occurs when the stacked sheets have a wide width.

SUMMARY OF THE INVENTION

It is an objective of the present invention to overcome the above-described problems and provide a sheet-supply device that properly supplies sheets one at a time, without double-sheet feed problems, and that can properly prevent even pliable sheets from sliding downstream all at once.

A sheet-supply device according to the present invention is for supplying sheets from a stack of sheets one at a time in a guide direction. The sheet-supply device includes a sheet supporting member, a sheet feed unit, a guide member, a stopper member, and a stopper moving mechanism.

The sheet supporting member has a sheet-supporting surface that supports the stack of sheets.

The sheet feed unit applies a force to a sheet in the stack to move the sheet in a sheet feed direction.

The guide member is disposed at a downstream side of the sheet supporting member with respect to the sheet feed direction. The guide member has a guide surface that guides the sheet in the guide direction as the sheet slides across the guide surface. The guide surface generates a resistance to sliding movement of sheets.

The stopper member is disposed in the guide member and has a stack-slippage prevention surface capable of imparting a larger resistance to sliding movement of sheets than the guide surface. The stopper member is movable between a protruding position and a retracted position. In the protruding position, the stack-slippage prevention surface of the stopper member protrudes away from the guide surface in a direction substantially opposite from the sheet feed direction to a position into abutment with the stack of sheets to impart the larger resistance on the stack of sheets. In the retracted position, the stack-slippage prevention surface of the stopper member is retracted away from the guide surface in substantially the sheet feed direction to a position out of contact with the stack of sheets so that the stack-slippage prevention surface does not impart the larger resistance on the stack of sheets.

The stopper moving mechanism selectively moves the stopper member between the protruding position and the retracted position.

An image forming device according to the present invention includes a sheet-supply device and an image forming portion.

The sheet-supply device is for supplying sheets from a stack of sheets one at a time in a guide direction. The sheet-supply device includes a sheet supporting member, a sheet feed unit, a guide member, a stopper member, and a stopper moving mechanism.

The sheet supporting member has a sheet-supporting surface that supports the stack of sheets.

The sheet feed unit applies a force to a sheet in the stack to move the sheet in a sheet feed direction.

The guide member is disposed at a downstream side of the sheet supporting member with respect to the sheet feed direction. The guide member has a guide surface that guides the sheet in the guide direction as the sheet slides across the guide surface. The guide surface generates a resistance to sliding movement of sheets.

The stopper member is disposed in the guide member and has a stack-slippage prevention surface capable of imparting a larger resistance to sliding movement of sheets than the guide surface. The stopper member is movable between a protruding position and a retracted position. In the protruding position, the stack-slippage prevention surface of the stopper member protrudes away from the guide surface in a direction substantially opposite from the sheet feed direction to a position into abutment with the stack of sheets to impart the larger resistance on the stack of sheets. In the retracted position, the stack-slippage prevention surface of the stopper member is retracted away from the guide surface in substantially the sheet feed direction to a position out of contact with the stack of sheets so that the stack-slippage prevention surface does not impart the larger resistance on the stack of sheets.

The stopper moving mechanism selectively moves the stopper member between the protruding position and the retracted position.

The image forming portion is disposed downstream from the sheet-supply device in the guide direction. The image forming portion forms images on sheets supplied by the sheet-supply device.

BRIEF DESCRIPTION OF THE DRAWINGS

In the drawings:

FIG. 20A shows a gear chain in the image forming device of the second embodiment for transmitting drive force from a sheet feed motor to a sheet feed roller, and selectively to the stopper members and a stopper position detecting sensor for detecting position of the stopper members, the gear chain being in the condition for transmitting the drive force to the sheet feed roller only;

FIG. 20B shows the gear chain of FIG. 20A in the condition for transmitting the drive force to the sheet feed roller and also to the stopper members and the stopper position detecting sensor, while the stopper members are in the protruding position;

FIG. 20C shows the gear chain of FIG. 20A in the condition of FIG. 20B, while the stopper members are in the retracted position;

DESCRIPTION OF THE PREFERRED EMBODIMENTS

Figure 1:
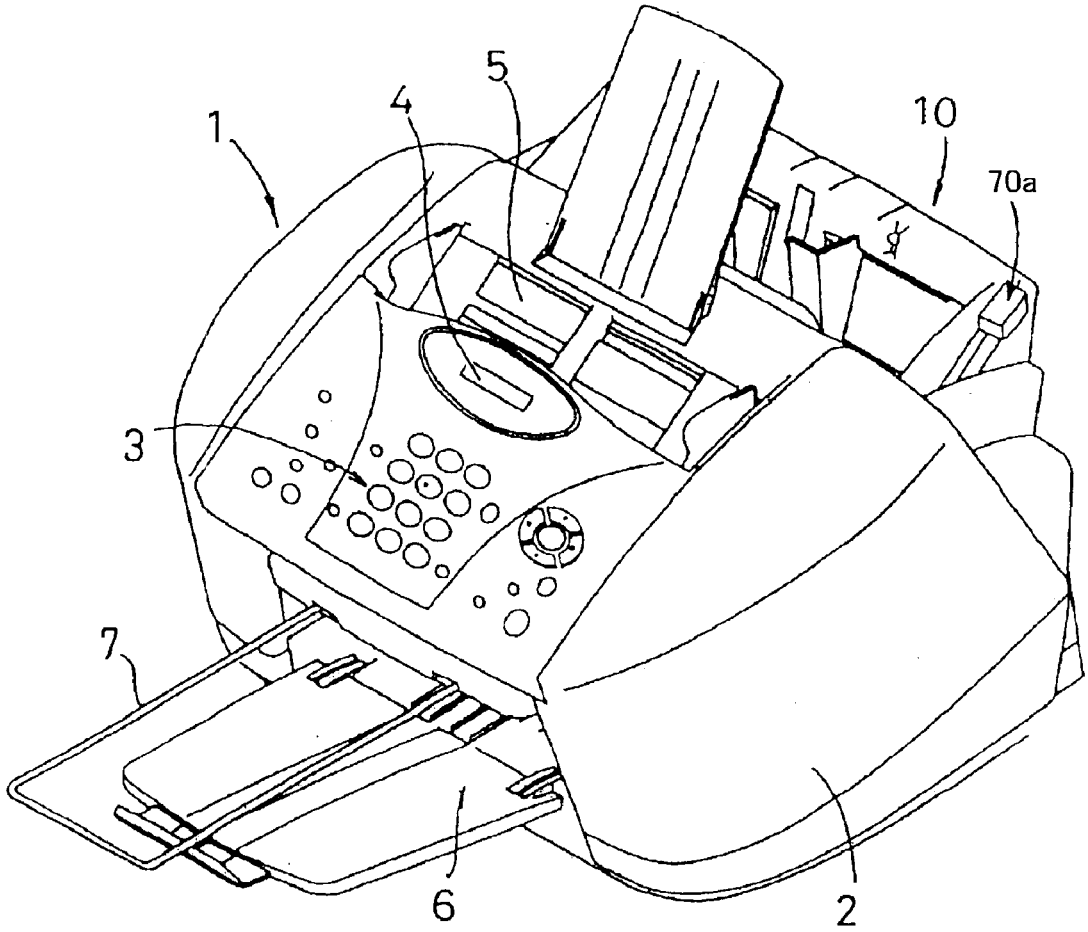
FIG. 1 is a perspective view showing an image forming device according to a first embodiment of the present invention.

Next, a multi-function image forming device 1 according to a first embodiment of the present invention will be described. In the following description, directional terms such as up, down, left, right, front, and rear will be used assuming that the multi-function image forming device 1 is in the orientation in which it is intended to be used as shown in FIG. 1. The multi-function image forming device 1 includes a facsimile function, a printer function, a copy function, and a scanner function.

As shown in FIG. 1, the multi-function image forming device 1 includes a box-shaped casing 2, an operation panel 3, a document tray 5, discharge trays 6, 7, and a sheet-supply device 10. Although not shown in the drawings, the multi-function image forming device 1 also includes a scanner and an image forming unit disposed inside the casing 2. The image forming section is a color ink jet type printing engine in the present embodiment.

The operation panel 3 is disposed in the upper surface of the casing 2. The operation panel 3 includes a plurality of buttons and a liquid crystal display (LCD) 4. The buttons include "0" to "9" number buttons, a start button, and a function operation button. The user can input various information and commands, such as selecting the suitable function, by pressing these buttons. The liquid crystal display 4 is disposed at the rear portion of the operation panel 3 and is for displaying the settings of the multi-function image forming device 1 and various operation messages. The document tray 5 is disposed behind the liquid crystal display 4 and the sheet-supply device 10 is provided to the rear of the document tray 5. The discharge trays 6, 7 are provided at the front of the casing 2 at a position below the operation panel 3.

The document tray 5 is for holding a document to be transmitted to a remote facsimile machine using the facsimile function or a document to be copied using the copy function. In either case, the document on the document tray 5 is fed to the scanner (not shown) one sheet at a time. The scanner scans each sheet and retrieves an image that corresponds to the image on the sheet. After image retrieval, the sheets of the document are discharged onto the discharge tray 7.

The sheet-supply device 10 is for supplying sheets P one at a time to the image forming section (not shown) in the casing 2. The plurality of sheets P are supported in the sheet-supply device 10 in a stack. The image forming section forms images on the supplied sheets P during the copy mode or during the facsimile mode, when image data is received in a data transmission from a remote facsimile machine. The sheet-supply device 10 supplies the sheets P one at a time to the image forming section (not shown) in the casing 2. After the image forming section prints images on a sheet, the sheet is discharged onto the discharge tray 6.

Figure 2:
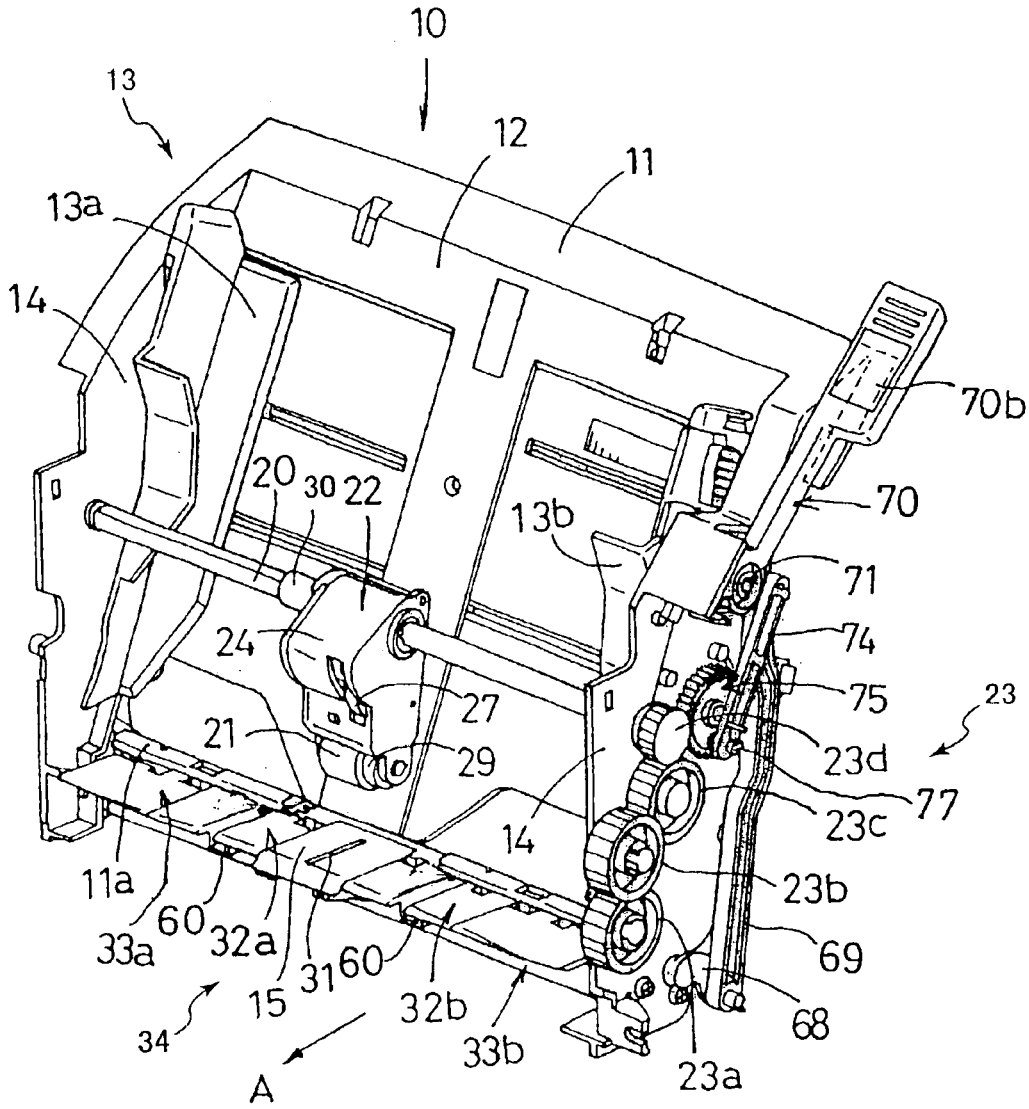
FIG. 2 is a perspective view showing a sheet-supply device of the image forming device of FIG. 1, the sheet-supply device including stopper members for preventing sheets stacked in the sheet-supply device from sliding out.

Next, the sheet-supply device 10 will be explained in further detail. As shown in FIG. 2, the sheet-supply device 10 includes a frame 11, a sheet guide unit 13, a sheet-supply roller unit 22, a gear chain 23, and a sheet separation section 34. The frame 11 includes a sheet-supporting surface 12 and a pair of side wall plates 14, 14. The sheet-supporting surface 12 and the side wall plates 14, 14 are all formed integrally from a synthetic resin, with the side wall plates 14, 14 connected integrally to left and right sides of the sheet-supporting surface 12. The sheet-supporting surface 12 slants downward and forward and is capable of supporting a plurality of sheets P in a stack. It should be noted that sheets P are supported on the sheet-supporting surface 12 with their widthwise direction extending in the left-right direction.

Figure 5:
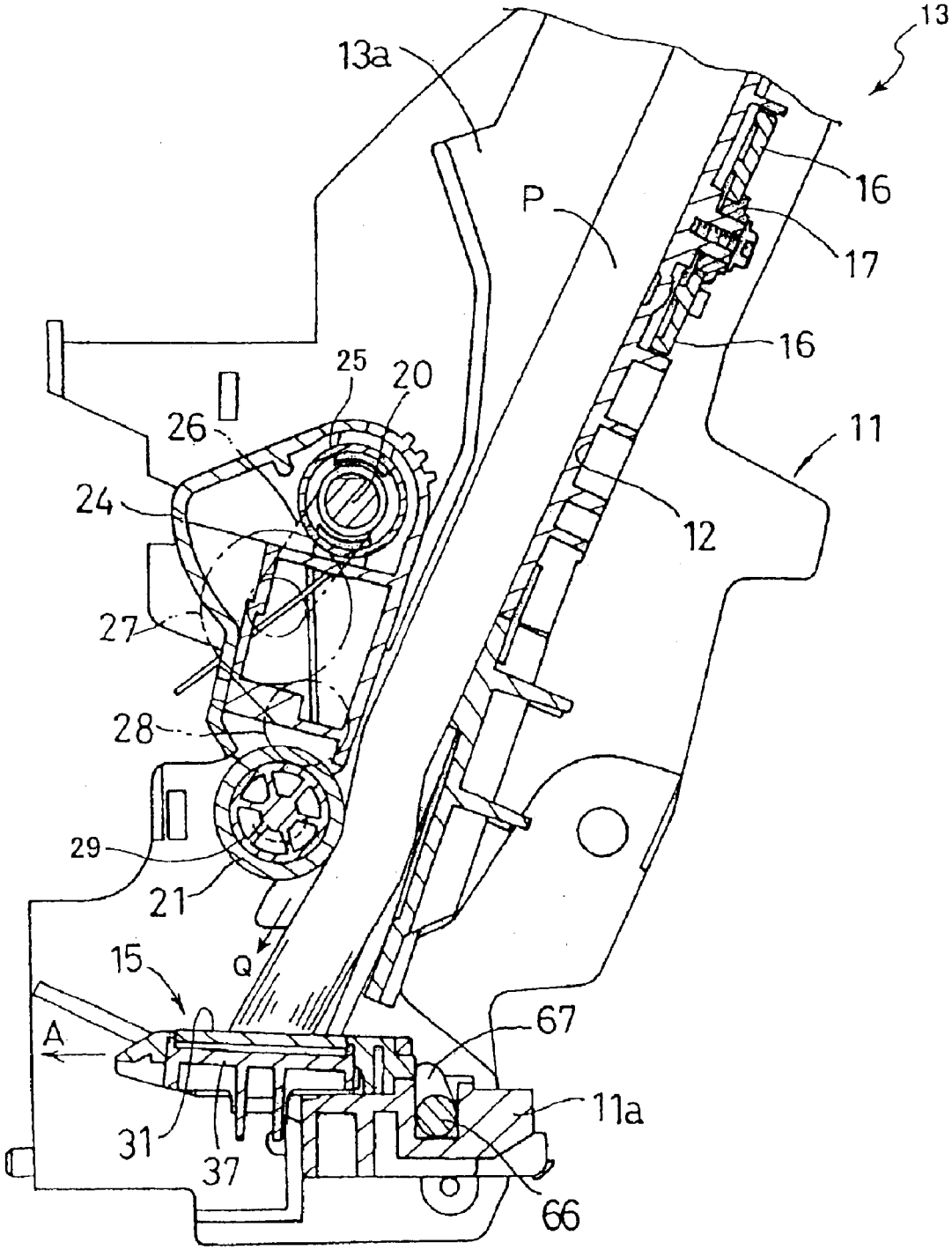
FIG. 5 is a sectional view taken along the line V—V of FIG. 4.

As shown in FIGS. 2 and 5, the sheet guide unit 13 includes guide plates 13*a*, 13*a*, racks 16, 16, and a pinion 17. The guide plates 13*a*, 13*a* are slidably disposed at the front of the sheet-supporting surface 12 at positions horizontally interior of the pair of side wall plates 14, 14. As shown in FIG. 5, the racks 16, 16 and the pinion 17 are disposed to the rear of the sheet-supporting surface 12. The racks 16, 16 extend horizontally and are connected one to each of the guide plates 13*a*, 13*a* through slits formed in the sheet-supporting surface 12. The pinion 17 is rotatably provided at a position in between and in meshing engagement with the racks 16, 16 so that the guide plates 13*a*, 13*a* are linked together.

With this configuration, when either of the guide plates 13*a*, 13*a* are shifted leftward or rightward across the sheet-supporting surface 12, the movement is transmitted to the other guide plate 13*a* through the pinion 17 and the racks 16, 16. As a result, the guide plates 13*a*, 13*a* move toward each other and away from each other in a ganged movement. This enables the user to easily center the stack of sheets P on the sheet-supporting surface 12. That is, the user sets the stack of sheets on the sheet-supporting surface 12 and shifts either of the guide plates 13*a*, 13*a* across the sheet-supporting surface 12 to abut against the side of the sheet stack. If the sheets are horizontally centered on the sheet-supporting surface 12, then the other guide plate 13*a* will abut against the other side of the sheet stack at this time. If not, then the user merely needs to continue moving the guide plate 13*a* (while shifting the sheet stack) until both guide plates 13*a*, 13*a* abut the opposite sides of the sheet stack. At this point, the sheet stack will be centered in the widthwise direction on the sheet-supporting surface 12.

Figure 4:
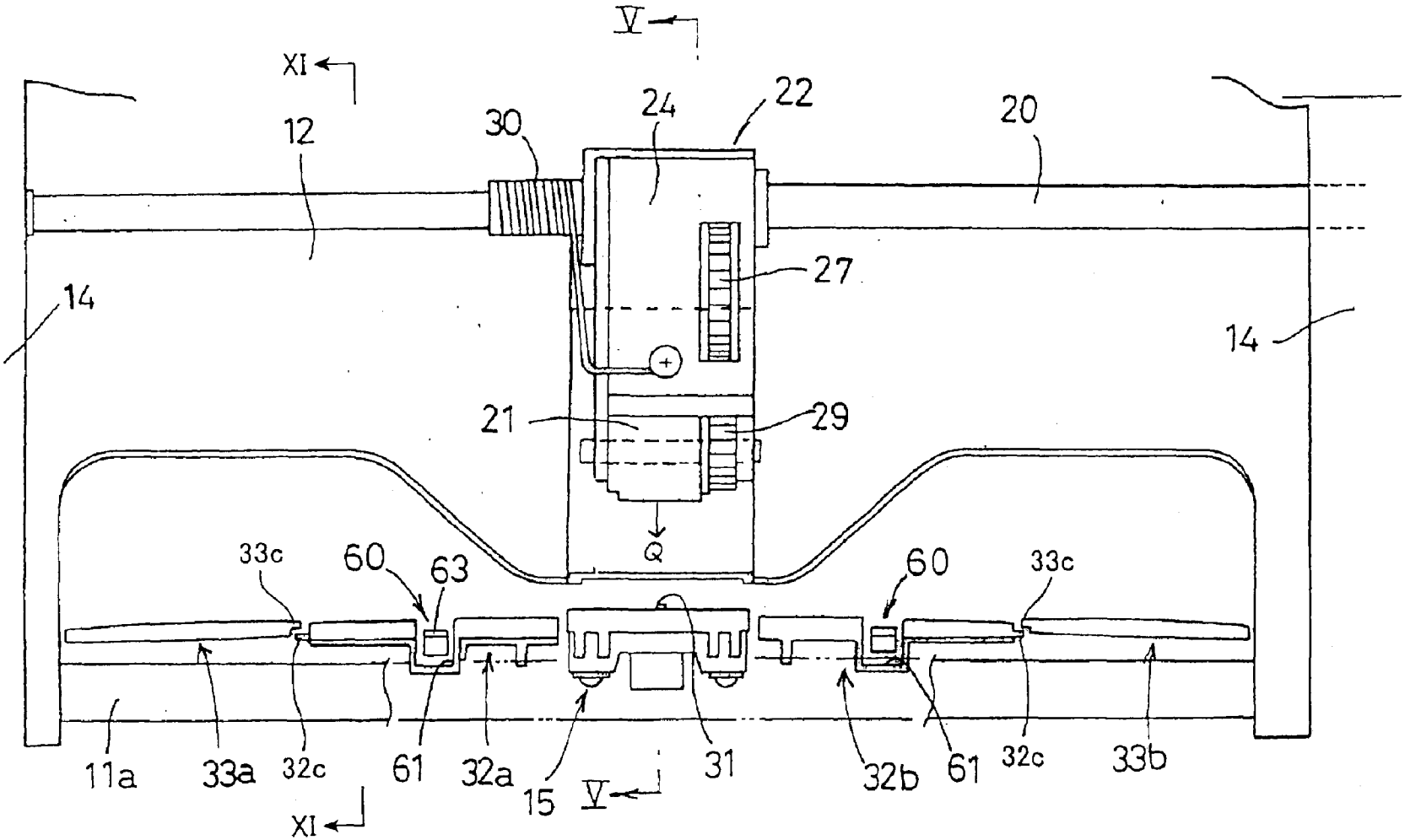
FIG. 4 is a front view showing the sheet-supply device of FIG. 2 with the stopper members in a retracted position.

As shown in FIGS. 2, 4 and 5 the sheet supply roller unit 22 includes a transmission shaft 20, a case 24, a sheet-supply roller 21, a gears 25, 27, 28, 29, an arm 26, and a torsion spring 30. The transmission shaft 20 is freely rotatably supported between the left and right side wall plates 14, 14, separated from the front surface of the sheet-supporting surface 12 by an appropriate distance. The case 24 is mounted on the transmission shaft 20 at a fixed position in the substantially left-right direction center of the transmission shaft 20. The case 24 is capable of pivoting with rotation of the transmission shaft 20. The sheet-supply roller 21 is rotatably mounted at the lower end of the case 24. The torsion spring 30 is fitted on the transmission shaft 20 and resiliently urges the case 24 so that the sheet-supply roller 21 presses on the upper surface of the stacked sheets P.

Configuration provided in the case 24 will be described with reference to FIG. 5. The drive gear 25 and the arm 26 are mounted on and pivot freely about the transmission shaft 20. The planetary gear 27 is freely rotatably supported on the tip of an arm 26 and is meshingly engaged with the drive gear 25. The gear 29 rotates integrally with the sheet-supply roller 21 and is meshingly engaged with the intermediate gear 28.

The gear chain 23 is disposed on the outer surface of one of the side wall plates 14, 14. The gear chain 23 is for transmitting power from a drive motor (not shown) disposed on the side of the casing 2 to various components of the multi-function image forming device 1. The gear chain includes gears 23*a*, 23*b*, 23*c*, and 23*d*. The gear 23*d* is fixed on the end of the transmission shaft 20.

Here, operation of the sheet supply roller unit 22 will be described. In this explanation, the directions "clockwise" and "counterclockwise" will be used to refer to rotational directions as viewed in FIG. 5. When sheets are to be supplied, the drive motor (not shown) disposed on the side of the casing 2 is driven to rotate the gear 23*d* counterclockwise. Accordingly, the transmission shaft 20 and the drive gear 25 rotate counterclockwise as well. The planetary gear 27 rotates clockwise so that the arm 26 pivots counterclockwise, bringing the planetary gear 27 into meshing engagement with the intermediate gear 28. As a result the intermediate gear 28 rotates counterclockwise and the gear 29 rotates clockwise. Therefore, the sheet-supply roller 21 rotates clockwise and feeds the uppermost sheet P in the stack downward as viewed in FIG. 4. The sheet-supply roller 21 generates a linear sheet-supply force Q indicated in FIG. 4.

On the other hand when the gear 23*d* is rotated clockwise so that the transmission shaft 20 and the drive gear 25 rotate clockwise, the planetary gear 27 rotates in counterclockwise so that the arm 26 pivots clockwise. This moves the planetary gear 27 out from meshing engagement with the intermediate gear 28 so that the sheet-supply roller 21 stops rotating and sheets are no longer fed out.

As shown in FIGS. 2, 3, 6, and 7, the sheet separation section 34 is located on a lower frame portion 11*a* at the lower end of the frame 11 and includes a fixed separation plate 15, a high-friction separation member 31, first movable separation plates 32*a*, 32*b*, second movable separation plates 33*a*, 33*b*, and torsion springs 42. The plates 15, 32*a*, 32*b*, 33*a*, 33*b* are made from synthetic resin and are for guiding sheets P fed out by the sheet-supply roller unit 22 in a guide direction A shown in FIGS. 2 and 5. As can be seen in the view of FIG. 2, the fixed separation plate 15 is located vertically below the sheet-supply roller 21 in the direction of the sheet-supply force Q, at a positions substantially in the widthwise center of the sheet-supporting surface 12. The first movable separation plates 32*a*, 32*b* are located on the left and right of the fixed separation plate 15. The second movable separation plates 33*a*, 33*b* are located to the left and right of the first movable separation plates 32*a*, 32*b*, that is, to the outer sides of the first movable separation plates 32*a*, 32*b* The upper surface of the sheet separation section 34 is formed by the upper surfaces of the plates 15, 32*a*, 32*b*, 33*a*, 33*b*. As can be seen in the view of FIG. 4, upper surfaces of the plates 15, 32*a*, 32*b*, 33*a*, 33*b* are shaped so that overall their upper surfaces form a slightly upwardly protruding convex shape with a radius of curvature of about 1,500 mm, wherein the left-right direction center is vertically closest to the sheet-supply roller 21 and the outer left and right edges are vertically farthest from the sheet-supply roller 21. That is, the upper surfaces of the plates 15, 32*a*, 32*b*, 33*a*, 33*b* are located farther from the sheet-supply roller 21 with respect to the sheet feed direction with increasing proximity to the outer edges of the second movable separation plates 33*a*, 33*b*. According to the present embodiment, the center of the upper surface of the sheet separation section 34 is about 2.0 mm to 3.0 mm higher than the outer edges, assuming that the outer edges of the pair of second movable separation plates 33*a*, 33*b* are separated by a distance of about 210 mm. Also, the upper surface of the sheet separation section 34 extends from the lower frame portion 11*a* at an obtuse angle of about 112.5 degrees with respect to the slanting plate 12.

The high-friction separation member 31 has a high friction coefficient and is disposed in the fixed separation plate 15. The high-friction separation member 31 is positioned at a horizontally central position of the fixed separation plate 15 and along the direction of the sheet-supply force Q. The high-friction separation member 31 protrudes above the upper surface of the fixed separation plate 15. As a result, the widthwise center of the lower edge of the fed-out sheets P abut against the high-friction separation member 31 and are separated from the stack. Because the high-friction separation member 31 is at the center of the fixed separation plate 15 and the upper surfaces of the plates 15, 32*a*, 32*b*, 33*a*, 33*b* are slightly convex shaped overall, the widthwise edges of the lower edge of the sheets P do not collide with the upper surfaces of the plates 15, 32*a*, 32*b*, 33*a*, 33*b*. Therefore the widthwise center of the lower edge of the sheets P properly abut against the high-friction separation member 31 and receive sufficient separation force. As a result, improper sheet supply of two sheets being fed at the same time can be prevented from occurring.

Figure 14B:
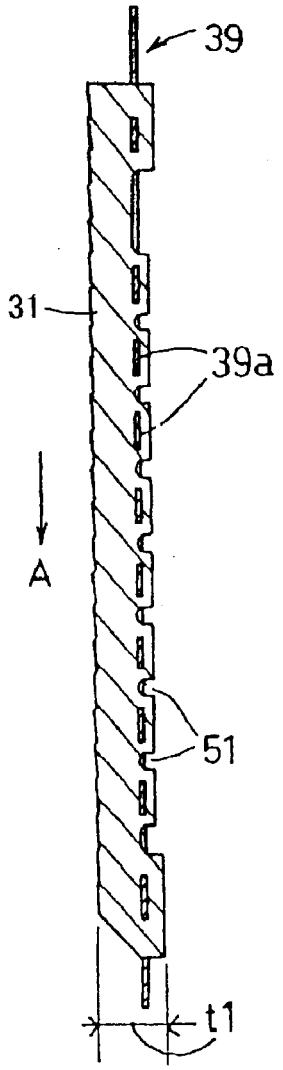
FIG. 14B is a sectional view taken along line XIVb—XIVb of FIG. 14A.
Figure 14A:
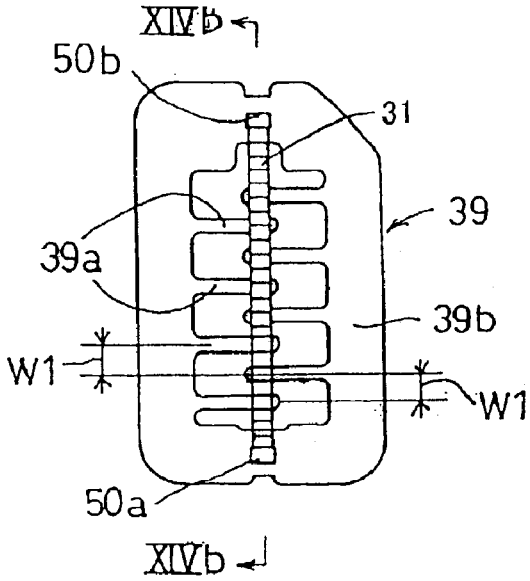
FIG. 14A is a plan view showing the high-friction separation member and a supporting plate spring.

As shown in FIG. 14B, it is desirable that the upper surface of the high-friction separation member 31 be formed in a shallow saw-toothed shape to apply a large friction resistance against the lower edge of the sheets P as the sheets P slide against the high-friction separation member 31. With this configuration, the shape, not just the material, of the high friction separation member 31 increases the coefficient of friction of the high-friction separation member 31.

Figure 10:
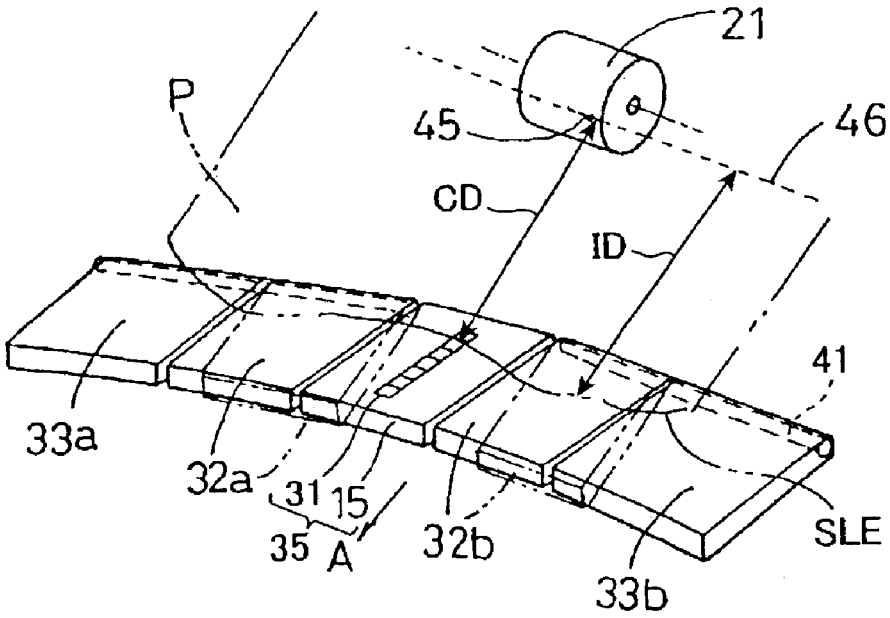
FIG. 10 illustrates the operation of a fixed separation plate and movable separation plates.
Figure 11:
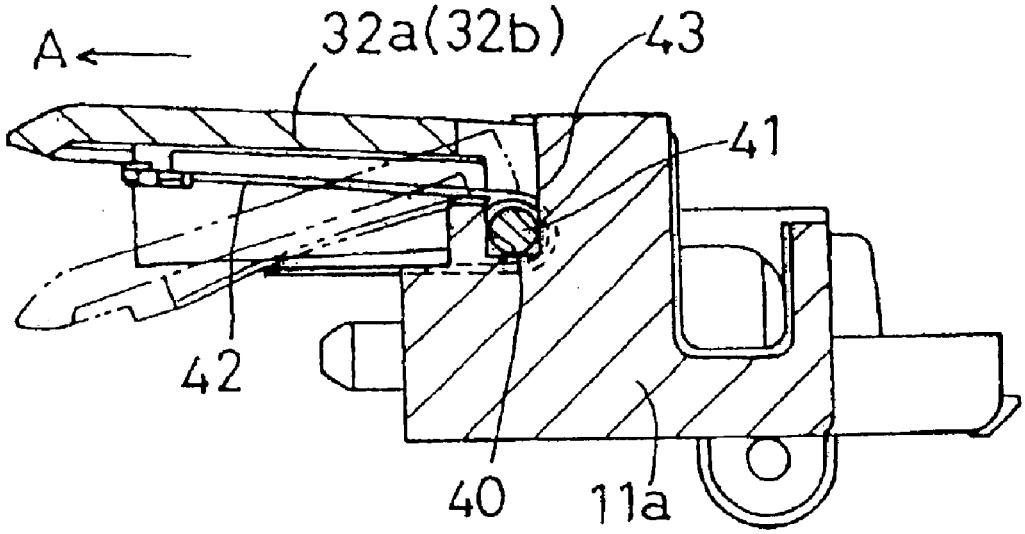
FIG. 11 is a sectional view taken along line XI—XI of FIG. 4 and illustrating movement of one of the movable separation plates.

As shown in FIGS. 10 and 11, the base edges of the movable separation plates 32*a* to 33*b* are each formed into a pivot shaft 41 that extends horizontally. The pivot shafts 41 are pivotably disposed in a bearing groove 40 that is formed in a lower portion 11*a* of the frame 11. The torsion springs 42 are each fitted on a corresponding one of the pivot shafts 41 with ends engaged at appropriate locations for generating a spring urging force that urges the movable separation plates 32*a* to 33*b* independently upward.

When the sheet-supply roller 21 feeds a sheet P downward, the lower edge of the sheet P abuts against the upper surfaces of the moveable separation plates 32*a*, 32*b* or 33*a*, 33*b*, depending on the width of the sheet P. The sheet P presses the corresponding moveable separation plates 32*a* to 33*b* downward so that the free end of each of the corresponding movable separation plates 32*a* to 33*b* pivots downward in a retraction movement against the upward spring urging force of the torsion spring 42. As a result, the movable separation plates 32*a* to 33*b* move out of the way under the pressing force of the sheet P. Because a torsion spring 42 is provided separately for each of the movable separation plates 32*a* to 33*b*, the upward spring urging force can be set to enable only the movable separation plates 32*a* to 33*b* that are located at locations appropriate for the horizontal width of the sheets P to pivot downward and retract. The resistance by the spring urging force will never be excessive or insufficient.

As shown in FIG. 11, the movable separation plates 32*a* to 33*b* are disposed in the bearing groove 40 so that a vertical base surface 43 of each abuts against the inner surface of the bearing groove 40 when the movable separation plates 32*a* to 33*b* are pivoted around the shafts 41 into a substantially horizontal posture. As a result, each of the first movable separation plates 32*a*, 32*b* is restricted so that its upper surface does not protrude upward above the upper surface of the adjacent fixed separation plate 15. Also, each of the second movable separation plates 33*a*, 33*b* is restricted so that its upper surface does not protrude upward above the upper surface of the adjacent first movable separation plate 32*a* (32*b*). It should be noted that a separate stopper can be provided to prevent the movable separation plates from pivoting upward more than necessary.

As shown in FIG. 4, each of the first movable separation plates 32*a*, 32*b* is formed with an engagement rib 32*c* that protrudes horizontally toward the adjacent one of the second movable separation plates 33*a*, 33*b*. Similarly, each of the second movable separation plates 33*a*, 33*b* is formed with an engagement rib 33*c* that protrudes horizontally toward the adjacent one of the first movable separation plates 32*a*, 32*b*. However, the engagement rib 32*c* of the first movable separation plates 32*a*, 32*b* extend below the engagement ribs 33*c* of the second movable separation plates 33*a*, 33*b*. With this configuration, when a downward load is applied to the second movable separation plate 33*a* (33*b*) so that the second movable separation plate 33*a* (33*b*) pivots downward, the engagement rib 33*c* of the second movable separation plate 33*a* (33*b*) presses the engagement rib 32*c* of the first movable separation plates 32*a*, 32*b* downward. Consequently, the first movable separation plate 32*a* (32*b*) pivots downward.

Figure 6:
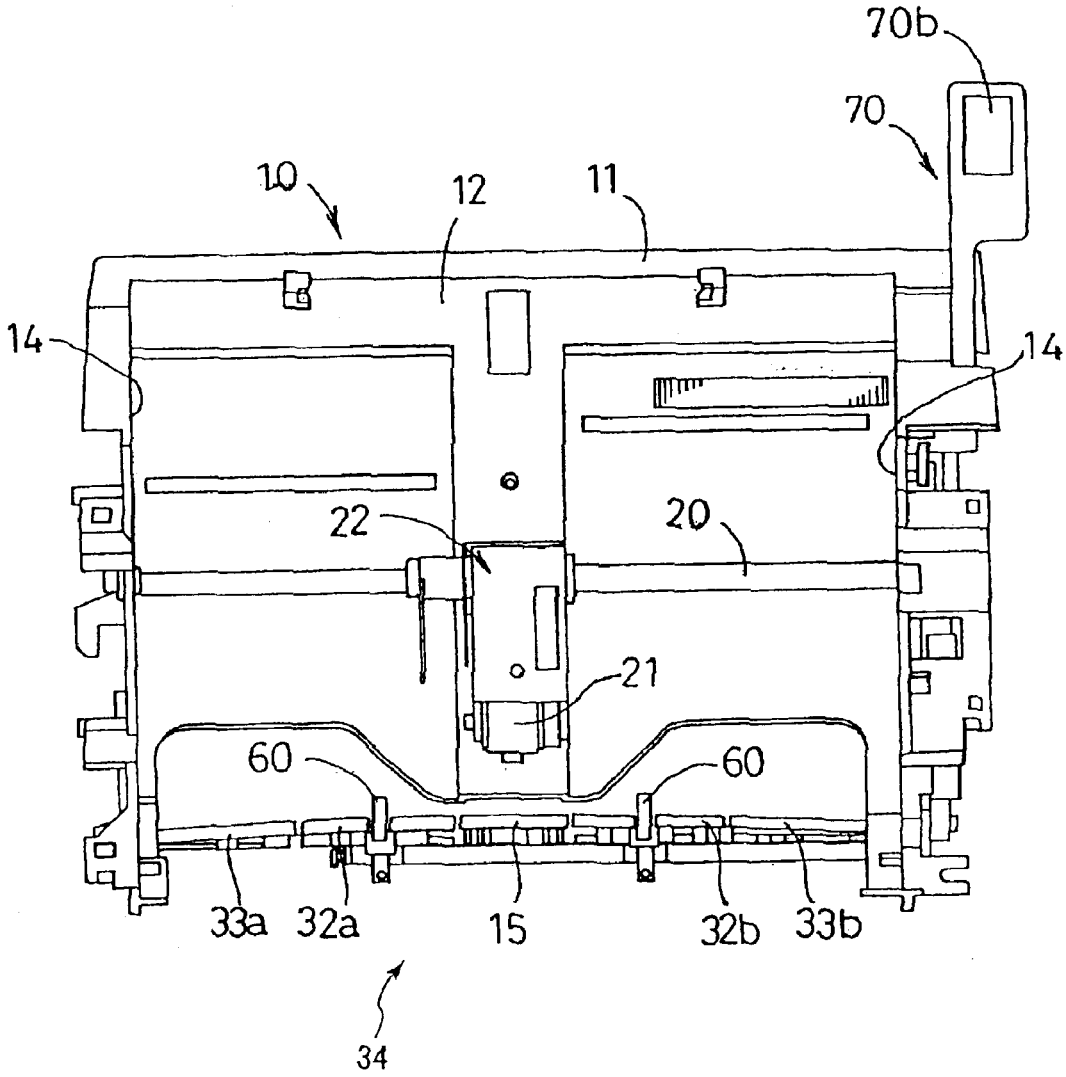
FIG. 6 is a front view showing the sheet-supply device of FIG. 2 with the stopper members in a protruding position.

Next, a pair of stopper members 60 will be described. The stopper members 60 are for preventing the sheets P on the sheet-supply device 10 from sliding downstream in the guide direction A. In other words, the stopper members 60 maintain the sheets P stacked on the sheet-supporting surface 12. As shown in FIGS. 2, 4, and 6, the stopper members 60 are disposed in upwardly open arrangement grooves 61 provided in the right and left first movable separation plates 32*a* and 32*b*. The stopper members 60 are pivotable between a protruding position shown in FIGS. 6, 7, and 8, and a retracted position shown in FIGS. 2, 3, and 4. The stopper members 60 are elongated and extend in substantially in the guide direction A while in the retracted position. As shown in FIG. 9, the base end of each stopper members 60 is fixed to a support shaft 62, which is rotatably supported on the upper side of the lower frame portion 11*a*. A high friction member 63 is provided on the upper surface of each stopper member 60. An operation arm 64 extends downward from the base end portion of each stopper members 60. One end of an urging spring 65 is engaged with each operation arm 64. The urging springs 65 urges the stopper members 60 to pivot downward into the retracted position indicated by the chain double-dashed line in FIG. 9, where the stopper members are retracted into the arrangement groove 61. While the stopper members 60 are in the retracted position in the arrangement groove 61, the upper surface of the high friction member 63 does not protrude above the upper surface of the first movable separation plate 32*a* (32*b*), even when the first movable separation plate 32*a* (32*b*) is pivoted into its downward slanting position.

Figure 3:
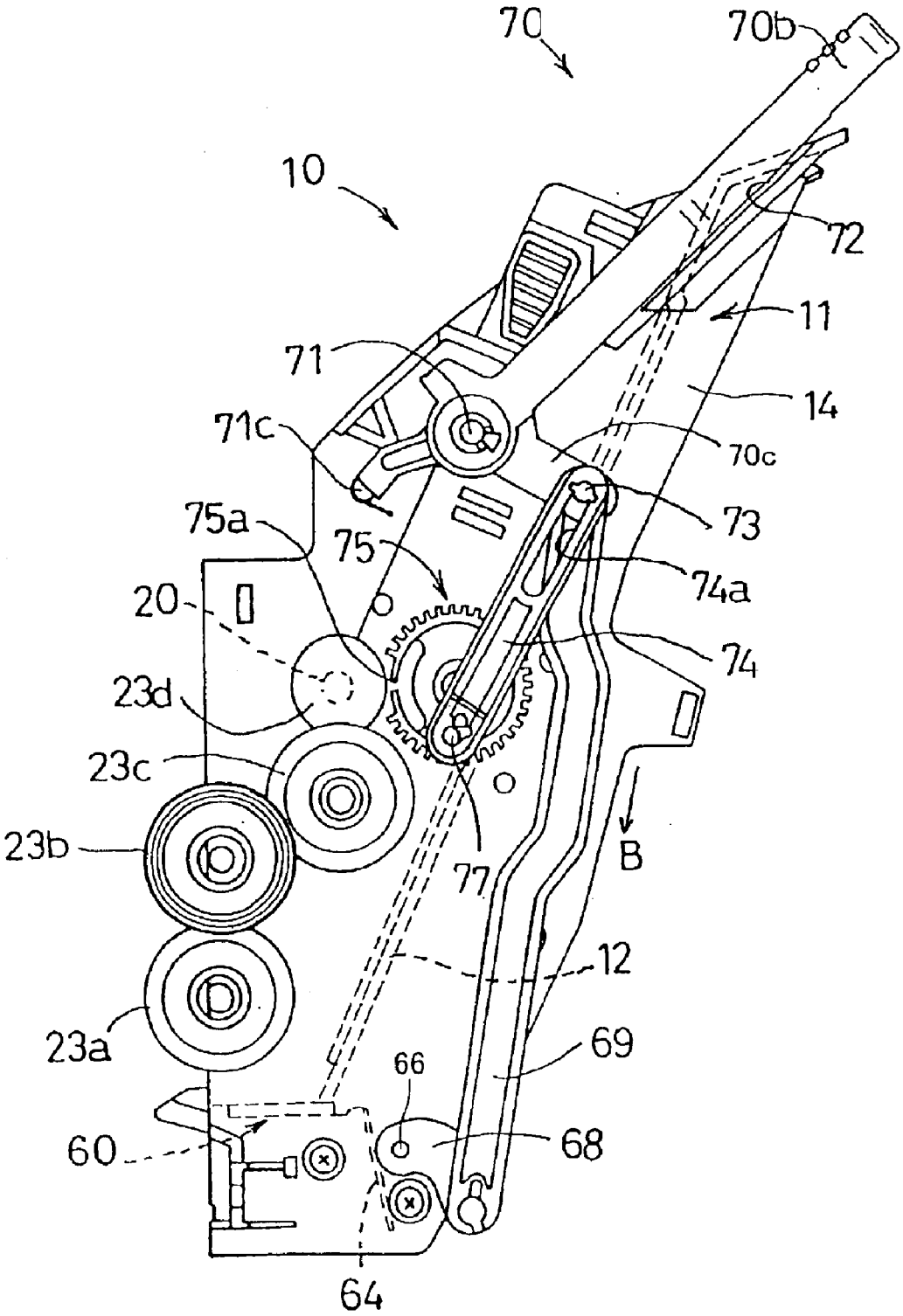
FIG. 3 is a right-hand side view showing the sheet-supply device shown in FIG. 2.

Next, an operation mechanism 70 for raising and lowering the stopper members 60 will be described. As shown in FIG. 8, the operation mechanism 70 is located substantially on the outer surface of the right side wall plate 14 and, as best shown in FIG. 8, includes a pivoting operation lever 70*a*, first and second links 68, 69, an operation shaft 66, cams 67 (only one shown), an urging spring 65, and operation arms 64 (only one shown). The pivoting operation lever 70*a* is pivotably mounted on a pin 71 that protrudes from the side wall plate 14. The pivoting operation lever 70*a* is pivotable between a sheet setting position shown in FIG. 8 and a sheet supply position as shown in FIG. 3. The pivoting operation lever 70*a* includes a handle 70*b* at its upper end and a connecting portion 70*c* that extends to the rear from the pin 71. The first and second links 68, 69 gangingly connect the connecting portion 70*c* with the operation shaft 66. The operation shaft 66 extends in parallel with the rotatable support shaft 62 at a position to the rear of the upper portion of the lower frame portion 11*a* of the frame 11. The operation shaft 66 is rotatably disposed with its lateral ends passing through the right and left side wall plates 14. The cams 67 are fixed on the operation shaft 66, each at the position of one of the operation arms 64.

When the handle 70*b* is pivoted clockwise from the sheet setting position of FIG. 8 into the sheet supply position of FIG. 3, then as shown in FIG. 3 the second link 69 descends as indicated by the arrow B until the handle 70*b* abuts with an abutment member 72 on the outer surface of the right side wall plate 14 In association with the downward movement of the second link 69, the first link 68 pivots clockwise and the operation shaft 66 rotates clockwise. As shown indicated by the chain double-dashed line in FIG. 9, the cam 67 retracts from the rear surface of the operation arm 64 As a result, the stopper members 60 are pivoted downward by the urging force of the urging spring 65 into the retracted position below the upper surface of the first movable separation plate 32*a* (32*b*). A torsion coil spring 71*c* acting as a toggle spring is provided between the pivoting operation lever 70*a* and the side wall plate 14. The torsion spring 71*c* retains the pivoting operation lever 70*a* at the retracted and protruding positions shown in FIGS. 3 and 8, respectively.

Figure 7:
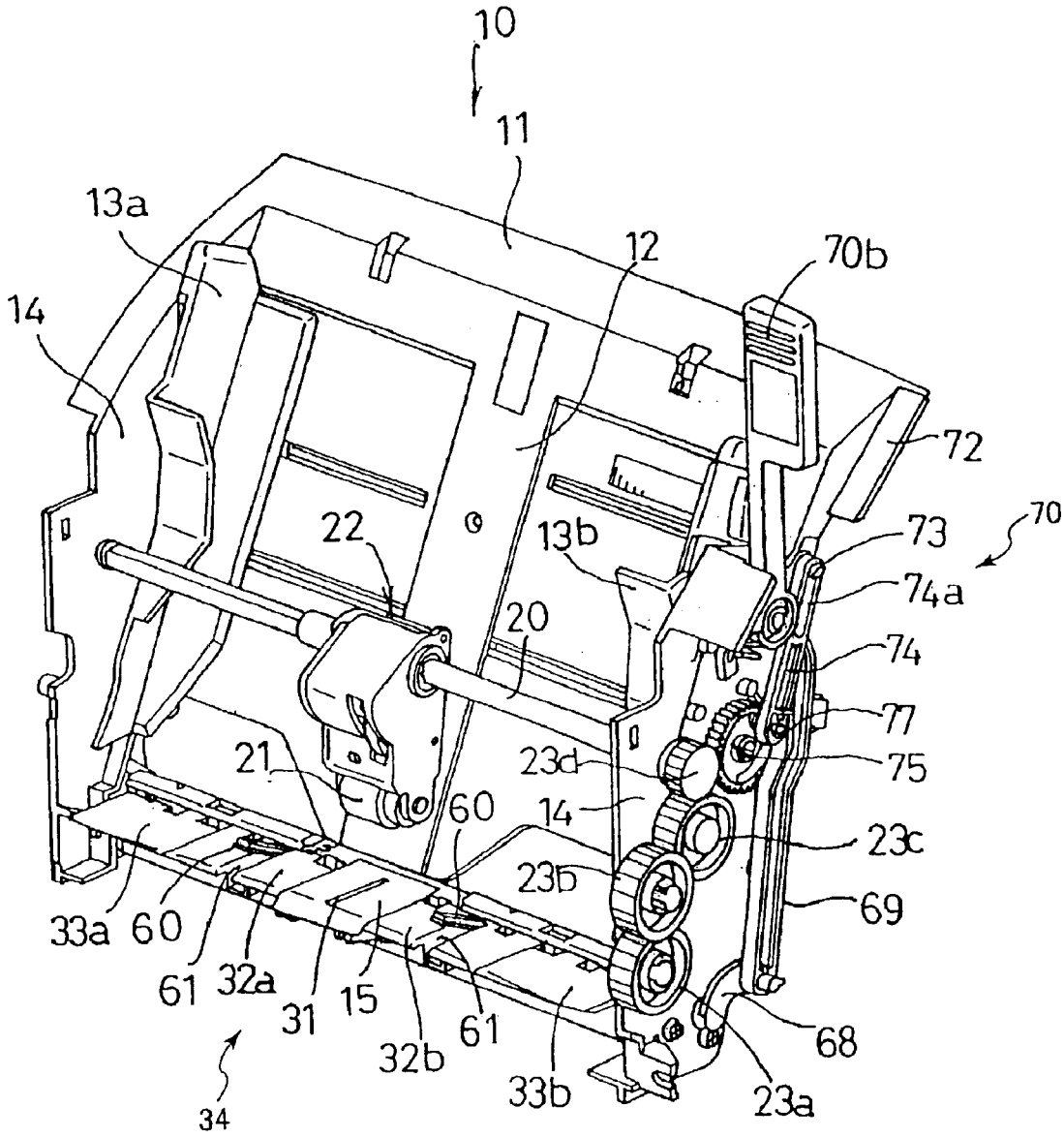
FIG. 7 is a perspective view showing the sheet-supply device with the stopper members in the protruding position.
Figure 8:
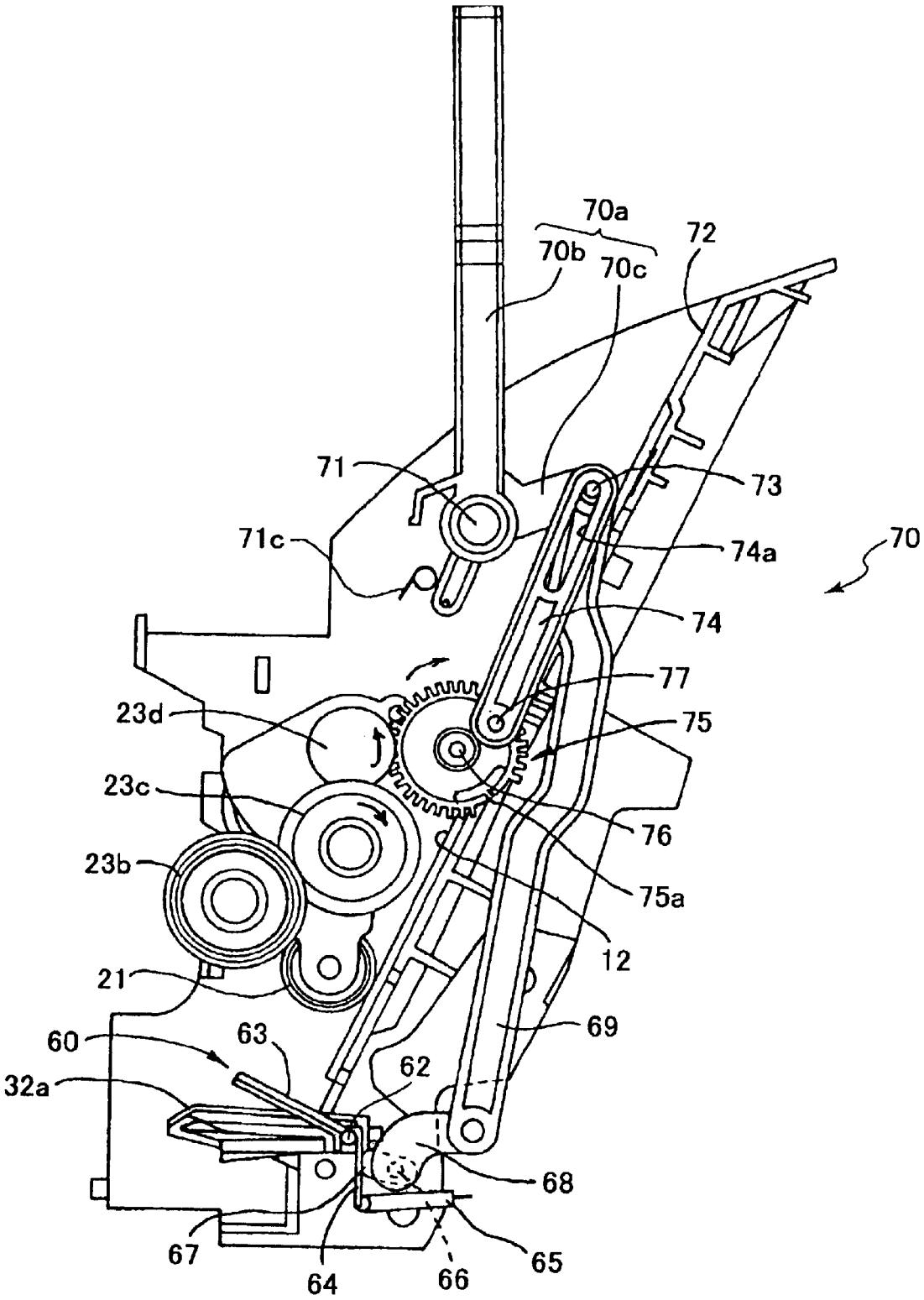
FIG. 8 is a right-hand side view showing the sheet-supply device with the right-hand wall plate removed and with the stopper members in the protruding position.
Figure 9:
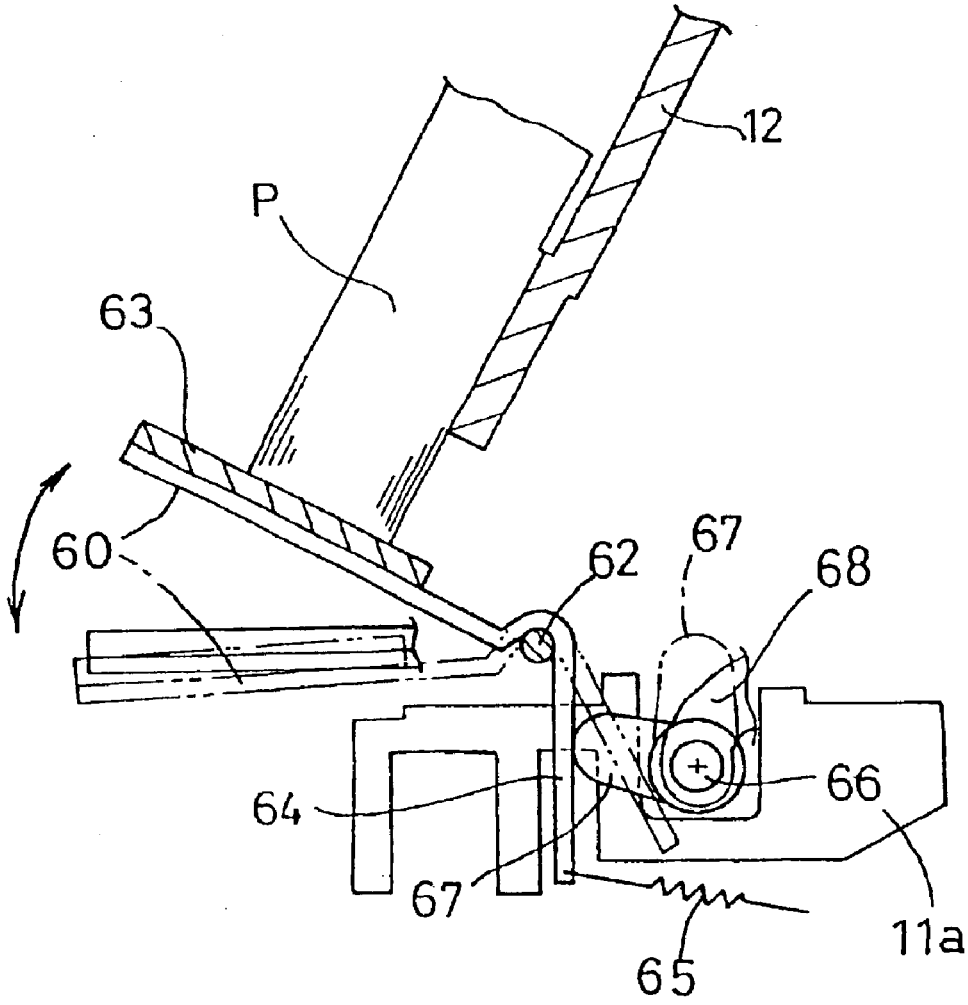
FIG. 9 illustrates how the stopper members are raised and lowered.

To place a plurality of sheets P in a stack on the sheet-supporting surface 12, the user pivots the handle 70*b* at the upper end of the pivoting operation lever 70*a* counterclockwise into the sheet setting position shown in FIGS. 7 and 8 away from the abutment member 72. At this time, the second link 69 rises up, the first link 68 pivots counterclockwise, and the operation shaft 66 rotates counterclockwise. In association with the counterclockwise rotation of the operation shaft 66, the cam 67 pivots counterclockwise against the urging force of the urging spring 65 into pressing contact against the rear surface of the operation arm 64. As a result, the stopper members 60 rises up above the upper surface of the first movable separation plate 32*a* (32*b*) into the protruding indicated in solid line in FIG. 9. When the stopper members 60 is raised into the protruding position, the upper surface of the high friction member 63 is oriented at approximately 30 degrees with respect to a horizontal plane. Further, the angle between the upper surface of the high friction member 63 and the surface of the sheet-supporting surface 12 is approximately 90 degrees. Because the high friction member 63 is located above the upper surface of the first movable separation plate 32*a* (32*b*), the lower edges of the sheets P stacked on the upper surface of the sheet-supporting surface 12 are upwardly separated from the upper surface of the sheet separation section 34. Because the high friction member 63 is oriented at approximately 30 degrees with respect to horizontal and approximately 90 degrees with respect to the surface of the sheet-supporting surface 12, the lower edge of the sheet stack slopes upward in the direction toward the sheet that is furthest from the sheet-supporting surface 12. Thus, even if the sheets P are rather pliable, they can be properly set on the sheet-supporting surface 12, and there is no danger of their flowing downwards all at once. This stack maintaining performance can be made substantially fixed independently of the number of sheets P stacked together.

The user stack sheets P onto the sheet-supporting surface 12 after pivoting the pivoting operation lever 70*a* into the sheet setting position shown in FIG. 8. As mentioned previously, at this point the stopper members 60 are raised up to maintain the sheets P in the stacked state. However, the stopper members 60 also raise the lower edges of the sheets P above the upper surface of the high-friction separation member 31 so that the sheet separating action of the high-friction separation member 31 cannot be exerted on the sheets P in the stack. Therefore, if the user forgets to pivot the pivoting operation lever 70*a* clockwise into the sheet supply position shown in FIG. 3, there is a danger that sheets will not be properly separated from the stack. 3. However, the multi-function image forming device 1 of the first embodiment includes an automatic resetting mechanism to restore the stopper members 60 to the retracted position even if the user forgets to pivot the pivoting operation lever 70*a* back into contact with the sheets P.

The automatic resetting mechanism includes a slanting link 74 and a partially-untoothed gear 75. The connecting portion 70*c* of the pivoting operation lever 70*a* includes a sliding pin 73 that protrudes laterally. The slanting link 74 is formed with an elongated hole 74*a*. The sliding pin 73 is engaged in the elongated hole 74*a*. The partially-untoothed gear 75 is rotatably supported about a shaft 76 on the outer surface of the side wall plate 14. The partially-untoothed gear 75 is formed with a laterally protruding pin 77. The pin 77 is rotatably engaged with the lower end of the slanting link 74. The partially-untoothed gear 75 is in meshing engagement with the gear 23*d*, which is fixed to one end of the transmission shaft 20. The partially-untoothed gear 75 includes an untoothed portion 75*a* that faces the gear 23*d* when the handle 70*b* of the pivoting operation lever 70*a* is in the sheet supply position in the abutment member 72 (i.e., when the stopper members 60 are lowered).

It is desirable that that the sliding pin 73, the pin 77, and axis of the gear 23*d* be arranged so that whether the handle

70*b* is in the sheet supply position (where it abuts the abutment member 72 as shown in FIG. 3) or in the sheet setting position (where it is greatly spaced apart therefrom as shown in FIG. 8), an imaginary line defined by the sliding pin 73 and the pin 77 cross an imaginary line defined by the sliding pin 73 and the axis of the gear 23*d*, that is, the lines do not overlap each other in the same line. Further, it is desirable that when the handle 70*b* is in the sheet setting position, the partially-untoothed gear 75 must only rotate a short distance (small angle) to move the untoothed portion 75*a* out of confrontation with the gear 23*d* so that the partially-untoothed gear 75 becomes meshingly engaged with the gear 23*d*.

The automatic resetting mechanism operates in the following manner. It will be assumed that the pivoting operation lever 70*a* is in the sheet setting position shown in FIG. 8 at the start of a sheet feed operation performed, for example, to discharge a sheet that remains in the image forming device 1 when power is turned on. As shown in FIG. 8, the untoothed gear 75 is in meshing engagement with the gear 23*d* at this time, so both forward and reverse rotation of the driving motor (not shown) at the start of the sheet feed operation rotates the untoothed gear 75 with the gear 23*a*. The slanting link 74 is pulled downward by rotation of the untoothed gear 75. Because the sliding pin 73 abuts against the inner upper edge of the slanting link 74, the pivoting connecting portion 70*c* is pulled downward by the slanting link 74. This pivots the operation lever 70*a* clockwise (as viewed in FIG. 8). When the pivoting operation lever 70*a* reaches the position of FIG. 3, the stopper members 60 are retracted into the retracted position. Also, the untoothed portion 75*a* has been rotated into confrontation with the gear 23*d*, so that further transmission of torque to the pivoting operation lever 70*a* is shut off.

When the user manually moves the pivoting operation lever 70*a* back from the sheet setting position shown in FIG. 8 into the sheet supply position shown in FIG. 3, the sliding pin 73 slides freely downs in the elongated hole 74*a* in the pivoting operation lever 70*a*. Therefore, the stopper members 60 can be moved from the protruding position to the retracted position without moving the slanting link 74.

As shown in FIGS. 12A to 14B, the fixed separation plate 15 includes a resilient support plate 39 and a synthetic-resin base block 37. The fixed separation plate 15 is formed with a slot 36 opened vertically through the left-right center of the upper surface of the fixed separation plate 15. The slot 36 is elongated following the guide direction A in which sheets are guided by the plates 15, 32*a*, 32*b*, 33*a*, 33*b* of the sheet separation section 34. The high-friction separation member 31 is inserted from the underside surface of the fixed separation plate 15 and disposed in the slot 36. The high-friction separation member 31 is made from a material having a high coefficient of friction, such as polyester urethane resin. The base block 37 is fitted into the lower surface of the fixed separation plate 15. Screws 38, 38 are screwed through attachment portions 37*b* from the underside surface of the base block 37. With this arrangement, the fixed separation plate 15 is detachably connected to the base block 37 by the screws 38, 38.

Figure 12A:
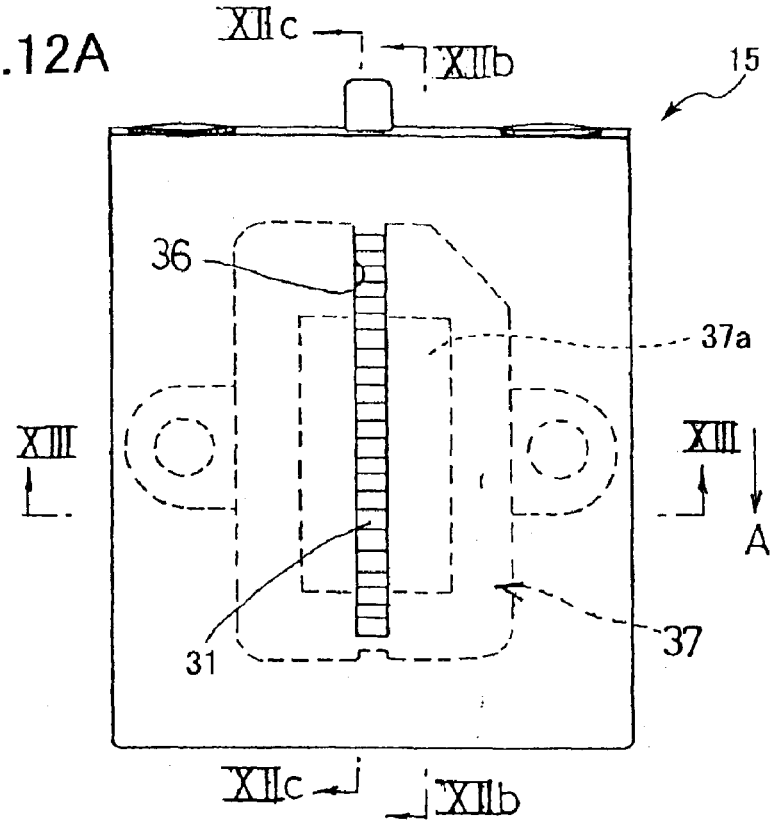
FIG. 12A is a plan view of the fixed separation plate including a high-friction separation member.
Figure 12B:
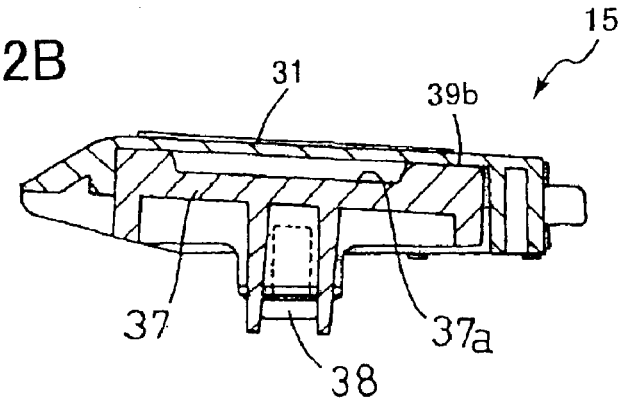
FIG. 12B is a sectional view taken along line XIIb—XIIb of FIG. 12A.
Figure 12C:
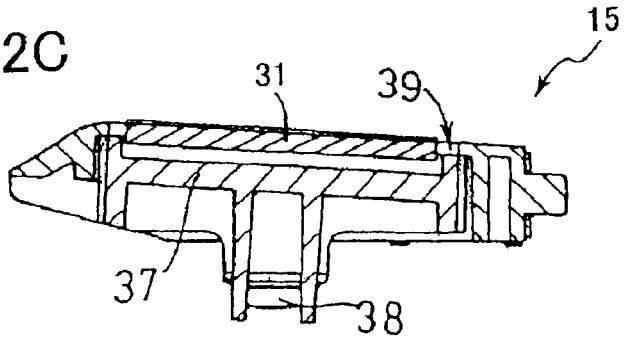
FIG. 12C is a sectional view taken along line XIIc—XIIc of FIG. 12A.
Figure 13:
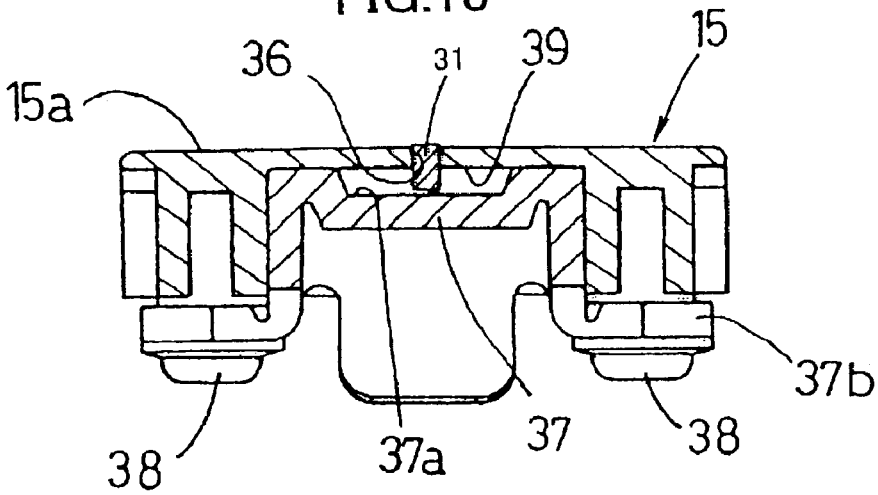
FIG. 13 is a sectional view taken along line XIII—XIII of FIG. 12A.

As shown in FIG. 12A, the resilient support plate 39 is made integrally from metal, such as phosphor bronze, and is substantially rectangular shaped when viewed in plan. The resilient support plate 39 includes an outer peripheral frame 39*b* and a plurality of resilient cantilevers 39*a*. The outer peripheral frame 39*b* has a substantially rectangular shape when viewed in plan, wherein the longer sides extend in the guide direction A. As viewed in plan, the resilient cantilevers 39*a* extend from the inner edges of the longer sides of the outer peripheral frame 39*b* in a direction perpendicular to the guide direction A. The resilient cantilevers 39*a* resiliently support the high-friction separation member 31 at their distal ends in the slot 36 so that the high-friction separation member 31 protrudes above the upper surface of the fixed separation plate 15.

In this condition, only the base plate 39*b* of the resilient support plate 39 is sandwiched between the upper surface of the base block 37 and the lower surface of the fixed separation plate 15. With this arrangement, the high-friction separation member 31 and the resilient cantilevers 39*a* are suspended over a hollow space. This increases the degree that the resilient cantilevers 39*a* and the high-friction separation member 31 can respond the pressing force from the sheet stack until it reaches the same level as the upper surface of the fixed separation plate 15.

As shown in FIG. 14B, the upper surface of the high-friction separation member 31, i.e., the left side face in FIG. 14B is formed in a shallow saw-toothed shape to apply a large friction resistance against the lower edge of the sheets P as the sheets P slide against the high-friction separation member 31. With this configuration, the shape, not just the material, of the high-friction separation member 31 increases the coefficient of friction of the high-friction separation member 31.

Next, an explanation will be provided for sheet supply operations performed by the sheet-supply device 10. First, the user stacks sheets P onto the sheet-supporting surface 12 so that the lower edge of all sheets P in the stack abuts against the high-friction separation member 31 and/or the upper surface of the fixed separation plate 15. However, the sheets P in the stack do not abut the upper surfaces of the first movable separation plate 32*a* (32*b*) and the second movable separation plate 33*a* (33*b*), because these are at a lower level.

Then, the user shifts the left and right guide plates 13*a*, 13*a* against the left and right edges of the stack of sheets P so that the widthwise direction center of the sheets P will be positioned at the left-right central position of the sheet-supporting surface 12.

When a print command is received from an external control device, such as a personal computer or an external facsimile machine, then the drive motor (not shown) is driven to rotate the transmission shaft 20 counterclockwise as viewed in FIG. 5 through the gear chain 23*a* to 23*d*. As a result, the sheet-supply roller 21 rotates in the clockwise direction of FIG. 5.

Once the sheet feed roller 21 begins rotating, the uppermost sheet in the stack receives the sheet-supply force Q of the sheet feed roller 21 so that the lower edge of the sheet is pressed against the high-friction separation member 31. Because the widthwise direction center of the sheets P is positioned at the left-right central position of the sheet-supporting surface 12 as is the sheet-supply roller 21 itself, the sheet-supply force Q is exerted on the substantial center of the sheets P.

If the sheet is a pliable one, then as the sheet feed roller 21 continues rotating the sheet will bend outward away from the other sheets in the stack at the portion of the sheet following the line of the sheet-supply force Q, that is, the portion between the position of the sheet feed roller 21 and the lower edge. Said differently, the pliable uppermost sheet is deformed into a convex shape such that the widthwise center is separated from the upper surface of the other stacked sheets P. This separates the uppermost sheet from other sheets in the stack. In the case of a firm sheet P, such as a thick paper sheet, the sheet is deformed into a concave shape such that the widthwise center presses closer to the other sheets in the stack.

Contrarily, portions of the sheet P that do not receive sheet-supply force Q, that is, portions nearer the widthwise edges of the sheets P, move forward while substantially flat against the sheet-supporting surface 12. As a result, as shown in FIG. 10, the center distance CD is shorter than the intermediate distance ID. The center distance CD is the linear distance from a nip line 45 to the lower edge of the sheet P. The nip line 45 is the position where the sheet-supply roller 21 abuts against the sheet P. The intermediate distance ID is the linear distance from somewhere along an extension line 46 to the lower edge of the sheet P. The extension line 46 is a line extending from the abutment line 45 to the widthwise edge of the sheet P. The abutment line 45 is the position where the sheet P received the sheet-supply force at the widthwise central portion of the sheet-supply roller 21. Said differently, the lower edge of the sheet P that is presently being fed out protrudes lower at portions nearer the widthwise edges than at the center.

Because the upper surface of the sheet separation section 34 has a fairly gentle arched shape, the first movable separation plate 32*a* (32*b*) and/or the second movable separation plate 33*a* (33*b*) properly support the left and right portions of the lower edge of pliable sheets P, which tend to sag down at the widthwise edges. Therefore, the pliable sheets can be prevented from slipping downstream without changing the height of the fixed separation plate 15. On the other hand, when the sheet P being fed out is a stiff type, the lower edge of the sheet P presses downward with a higher pressing force. At this time, the first movable separation plate 32*a* (32*b*) and the second movable separation plate 33*a* (33*b*) pivot downward against the urging force of the torsion spring 42. By this, the upper surface of the first movable separation plate 32*a* (32*b*) and the second movable separation plate 33*a* (33*b*) retract away from the lower edge of the sheet P so that they do not interfere with downward movement of the sheet P. Therefore, the widthwise center of the lower edge of the sheet P will properly abut against the high-friction separation member 31 so that the sheet P will be properly separated from the stack. Paper jams caused by two sheets P being fed out at the same time can be reliably prevented.

The stopper members 60 are in the retracted position and so do not protrude above the upper surface of the first movable separation plate 32*a* (32*b*) even if the first movable separation plate 32*a* (32*b*) pivots downward Therefore, the stopper members 60 do not interfere with the operation of the first movable separation plate 32*a* (32*b*).

The movable separation plates 32*a* to 33*b* operate differently depending on whether sheets P stacked on the sheet-supporting surface 12 are large or small sized. In the present embodiment the "size" of sheets P refers to the widthwise dimension of the sheets P in the horizontal direction. More particularly, sheets P are considered "small sized" when their left and right edges are located in between outer edges of the first movable separation plates 32*a*, 32*b*. On the other hand, sheets P are considered "large sized" when they are wider between their left and right edges than the distance between the inner sides of the left and right hand second movable separation plates 33*a*, 33*b*. When small sized sheets P are stacked on the sheet-supporting surface 12, the portions of the lower edge nearer the widthwise edges of the sheets P press the first movable separation plates 32*a*, 32*b* downward so that the first movable separation plates 32*a*, 32*b* retract by pivoting. However, the second movable separation plates 33*a*, 33*b* do not get in the way of the sheets P and so do not pivot downward at this time. When large sized sheets P are stacked on the sheet-supporting surface 12, portions of the lower edge of the sheets P that are near the widthwise edges of the sheets P abut against the upper surface of the second movable separation plates 33*a*, 33*b* so that the second movable separation plates 33*a*, 33*b* pivot downward At this time, the first movable separation plates 32*a*, 32*b* also pivot downward by the linking operation of the engagement ribs 32*c*, 33*c*. Therefore, the first movable separation plates 32*a*, 32*b* can be pivoted downward and interference between the lower widthwise edge of the sheet P can be even more reliably reduced, even if the portion of lower edge located between the widthwise center portion of the sheet P and the position near the widthwise edges does not abut the upper surface of the first movable separation plates 32*a*, 32*b*.

As described above, the high-friction separation member 31 protrudes above the upper surface of other components of the sheet separation section 34 at a position along sheet-supply force Q of the sheet feed roller 21, and also the upper surface of the sheet separation section 34 is formed with an upwardly protruding curved shape. As a result, the widthwise edge portions of the lower edge of fed out sheets do not collide into the sheet separation section 34. Only the substantially widthwise center of the lower edge of a fed out sheet abuts the high-friction separation member 31 and so receives the separating action to a sufficient degree, so that no double feeding of the sheets P occurs.

It should be noted that the upper surfaces of the fixed separation plate 15, the first movable separation plate 32*a* (32*b*), and the second movable separation plate 33*a* (33*b*) may be aligned flush with each other. With this configuration also, the same effects as described in the preceding paragraph can be achieved.

When the stopper members 60 are raised above into the protruding position, then even if pliable sheets P are stacked on the sheet-supporting surface 12, they will abut against the high-friction separation member 31 at an obtuse angle. Therefore, the lower edges of the stacked sheets P will be held properly in place and the sheets will not slide downstream side all at once. Thus, the operation of setting the sheets is facilitated.

Further, the high friction member 63 provided on the upper surface of each stopper members 60 prevents the sheets P on the stopper members 60 from sliding downstream as the raised stopper members 60 are being retracted.

Further, since each stopper members 60 is vertically pivotable about a pivot fulcrum situated on the side where the surface of the sheet-supporting surface 12 and the sheet separation section 34 intersect each other, the setting operation is facilitated with a simple construction in which it is only necessary to pivot each stopper members 60 about the pivot fulcrum. Further, the transition from the sheet setting condition to the sheet supplying condition can be effected smoothly. That is, as the stopper members 60 are being retracted, the sheets are gradually transferred onto the sheet separation section 34, starting with the sheet P nearest to the surface of the sheet-supporting surface 12, so that the sheets P are more effectively prevented from sliding downstream Further, when in the protruding position, the stopper members 60 are substantially at right angles with respect to the surface of the sheet-supporting surface 12, so that the lower edges of the sheets P stacked on the sheet-supporting surface 12 abut the stopper members 60 to be at approximately 90 degrees with respect to the surface of the sheet-supporting surface 12, thus making it possible to reliably maintain the set state.

Further, the sheet separation section 34 includes the fixed separation plate 15, the first movable separation plates 32*a* and 32*b*, and the second movable separation plates 33*a* and 33*b*. The fixed separation plate 15 is positioned centrally center with respect to the width direction of the sheets P and includes the high-friction separation member 31 having a high friction coefficient. The first movable separation plates 32*a* and 32*b* and the second movable separation plates 33*a* and 33*b* are arranged on the right and left sides of the fixed separation plate 15 and are capable of inclining downward when abutted by the sheets P. The stopper members 60 are arranged on the surface side of the first movable separation plates 32*a* and 32*b* and the second movable separation plates 33*a* and 33*b*, so that the right and left portions of the sheets P, stacked centered on the fixed separation plate 15, are supported by the stopper members 60, thereby realizing a stable set state.

Because the multi-function image forming device 1 includes the image forming device 10, sheets are supplied to the image forming unit one at a time so that sheets will be reliably printed on with desired images.

Figure 15:
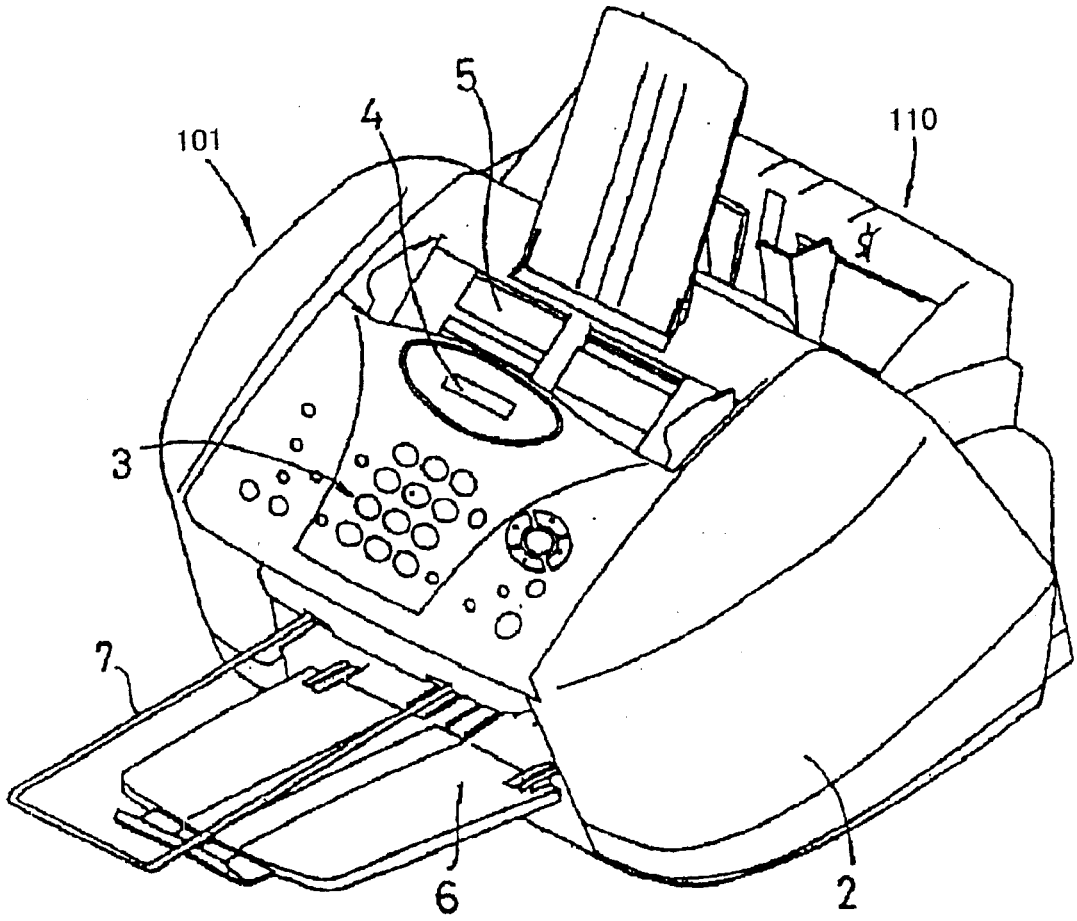
FIG. 15 is a perspective view showing an image forming device according to a second embodiment of the present invention.

Next, an image forming device 101 according to a second embodiment of the present invention will be described in detail with reference to the drawings. First the general construction of the image forming device 101 shown in FIG. 15 is the similar to that if the image forming device 1 of the first embodiment, so that a description thereof will be omitted.

Figure 16:
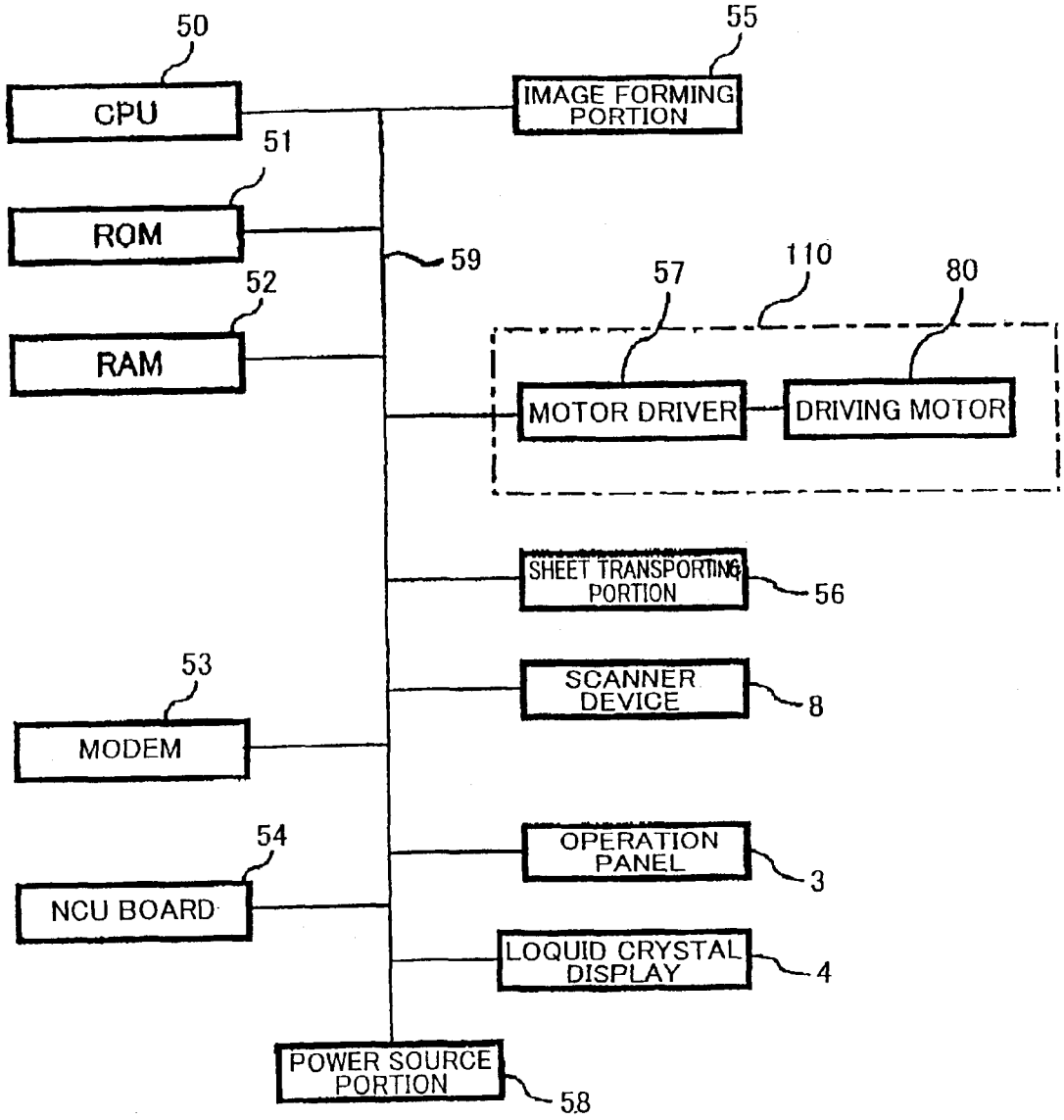
FIG. 16 is a block diagram representing a control portion for executing various functions of the image forming device of the second embodiment.

The image forming device 101 is equipped with a control portion for executing various functions. FIG. 16 is a block diagram showing this control portion.

As shown in FIG. 16, the control portion of the image forming device 101 is composed of a CPU 50, a ROM 51, a RAM 52, a modem 53, an NCU board 54, an image forming portion 55, a sheet-supply device 110, a sheet transporting portion 56, a scanner device 8, an operation panel 3, a liquid crystal display 4, and a power source 58, all connected through a bus line 59. The CPU 50 executes various controls and operations. The ROM 51 stores a control program for issuing commands for various control operations. A portion of the RAM 52 is used as a reception buffer memory. The NCU board 54 performs communication processing with other communication devices. The modem 53 transmits and receives communication data to and from other communication devices through the NCU board 54. The image forming portion 55 performs image processing by using a color ink jet system. The sheet transporting portion 56 drives and controls various sheet transport rollers provided in the image forming device 101. The sheet-supply device 110 is equipped with a driving motor 80 for driving the sheet feed roller 21 for feeding the stacked sheets one by one to the sheet transporting portion 56. The motor driver 57 drives and controls the driving motor 80. The scanner device 8 reads each widthwise extending line of the original. The operation panel 3 is equipped with various operating pushbuttons. The liquid crystal display 4 indicates the setting condition and the like of the image forming device 101. The power source portion 58 supplies electricity to the image forming device 101.

Next, the construction of the sheet-supply device 110 will be described. In the second embodiment, a separation plate 115 is disposed on a lower frame portion 111*a* at the lower end of a frame 111. The separation plate 115 supports the lower edges of the stacked sheets P and guides the sheets P to the image forming portion. A high-friction separation member 131 is provided in the separation plate 115. The separation plate 115 extends in a guide direction A.

Figure 17:
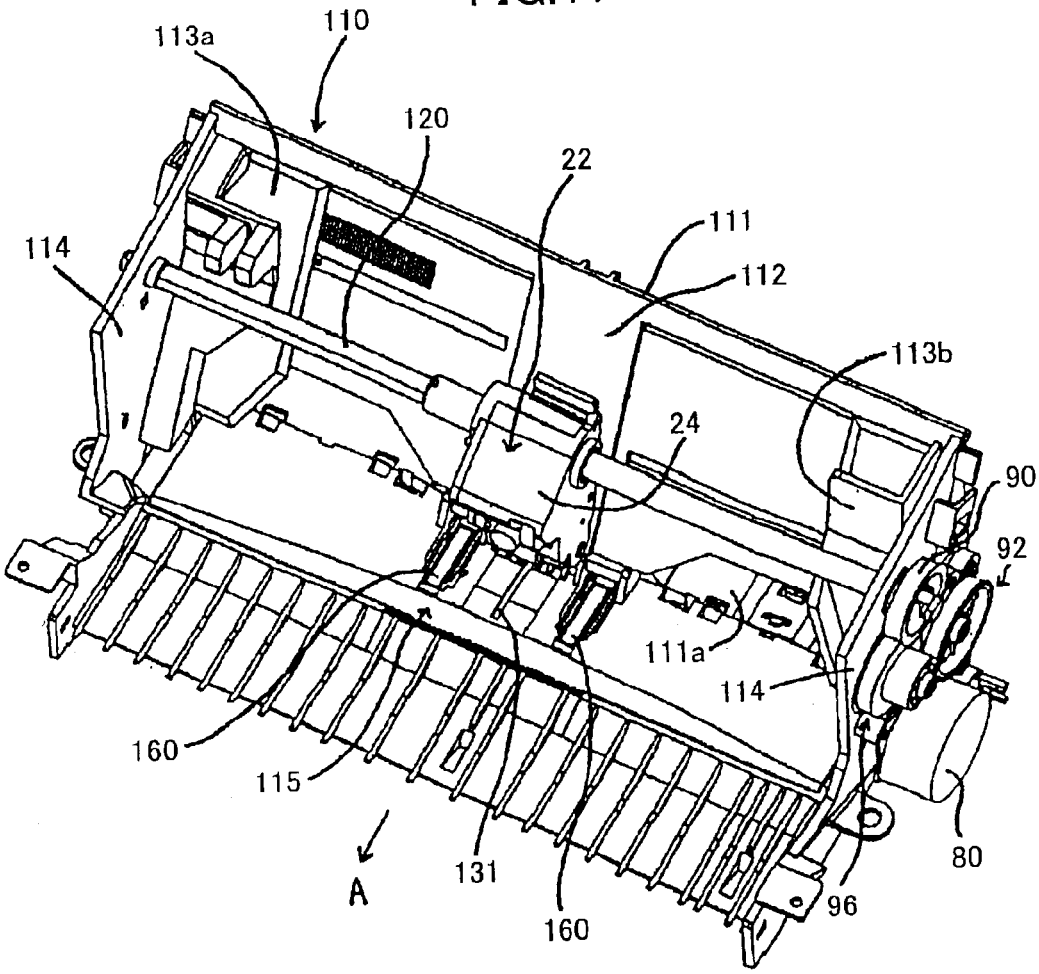
FIG. 17 is a perspective view showing a sheet-supply device of the image forming device of FIG. 15.
Figure 19:
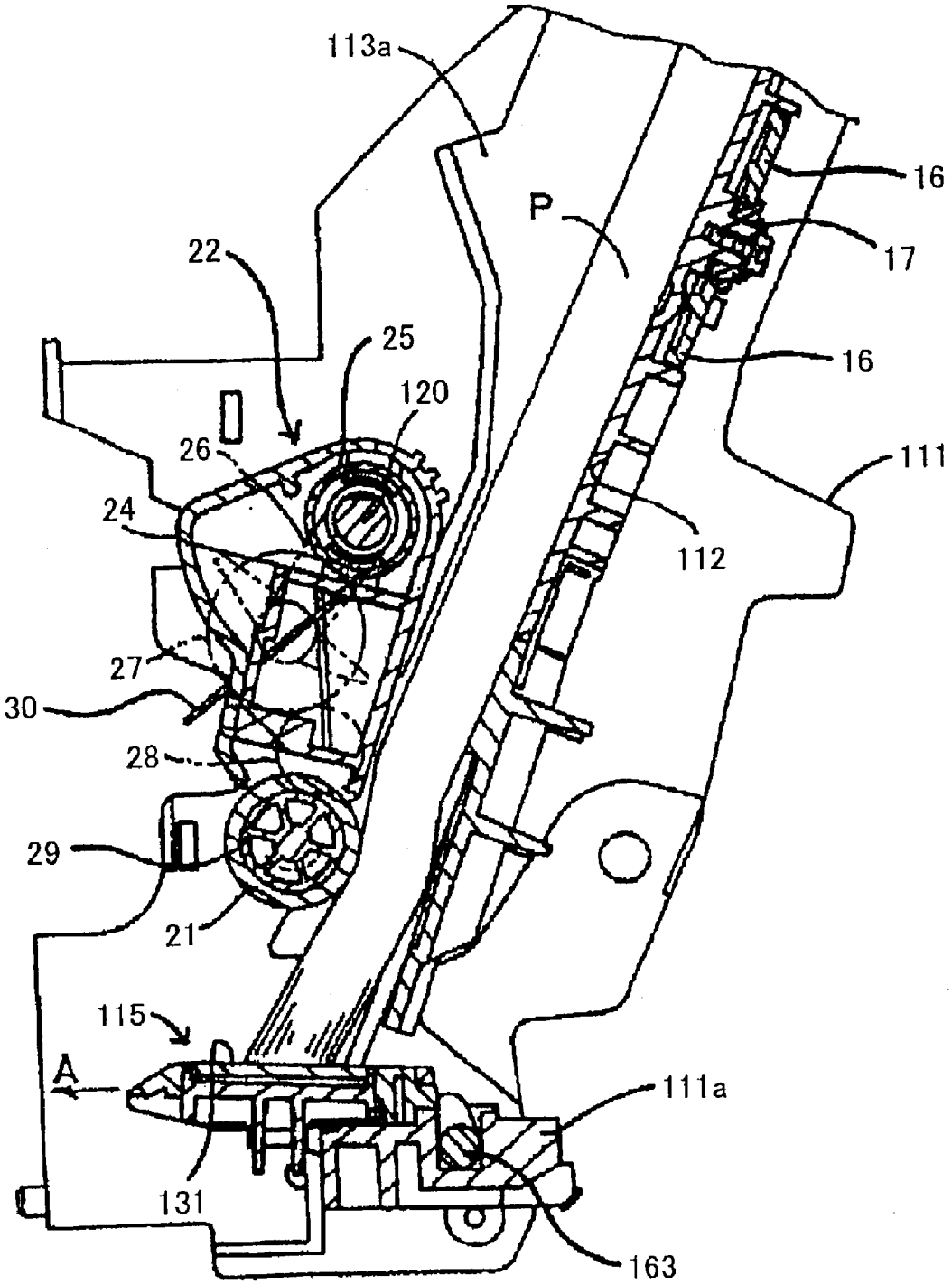
FIG. 19 is a sectional view taken along the line XIX—XIX of FIG. 18.

The separation plate 115 is oriented with its upper surface inclined by approximately 3 degrees from horizontal, so that the forward end in the guide direction A in FIGS. 17 and 19 is raised with respect to a horizontal plane. The upper surface of the separation plate 115 and the sheet-supporting surface 112 define an obtuse angle of approximately 110 degrees.

As shown in FIG. 17, the driving motor 80, a chain of gears 90 through 97 for transmitting power from the driving motor 80, a cam gear 81, a stopper position detecting sensor 82, and the like are disposed on right-hand one of side wall plates 114, 114. The gear 90 is fixedly attached to an end portion of a transmission shaft 120.

Figure 18:
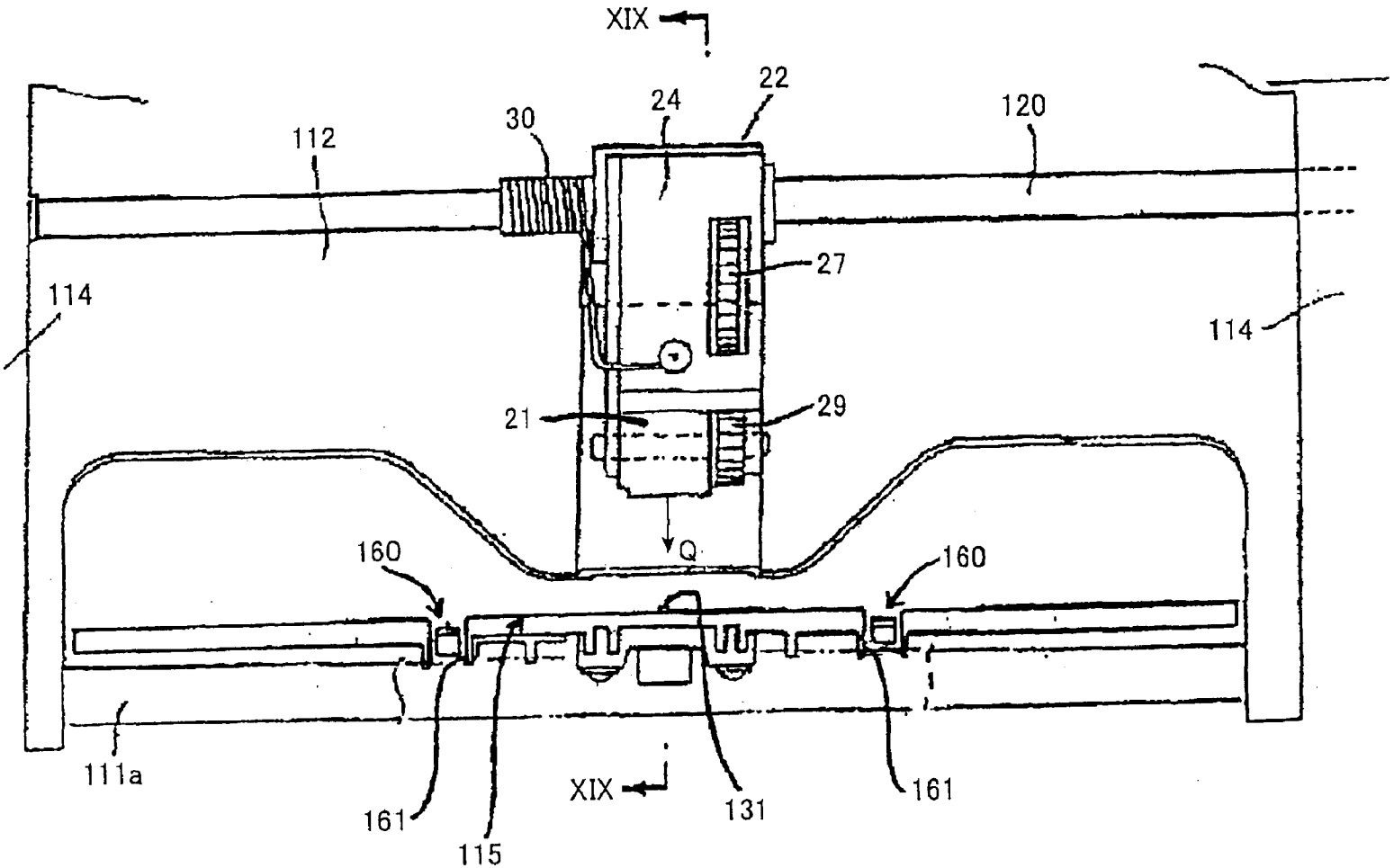
FIG. 18 is a front view showing main portions of the sheet-supply device of FIG. 17.
Figure 22:
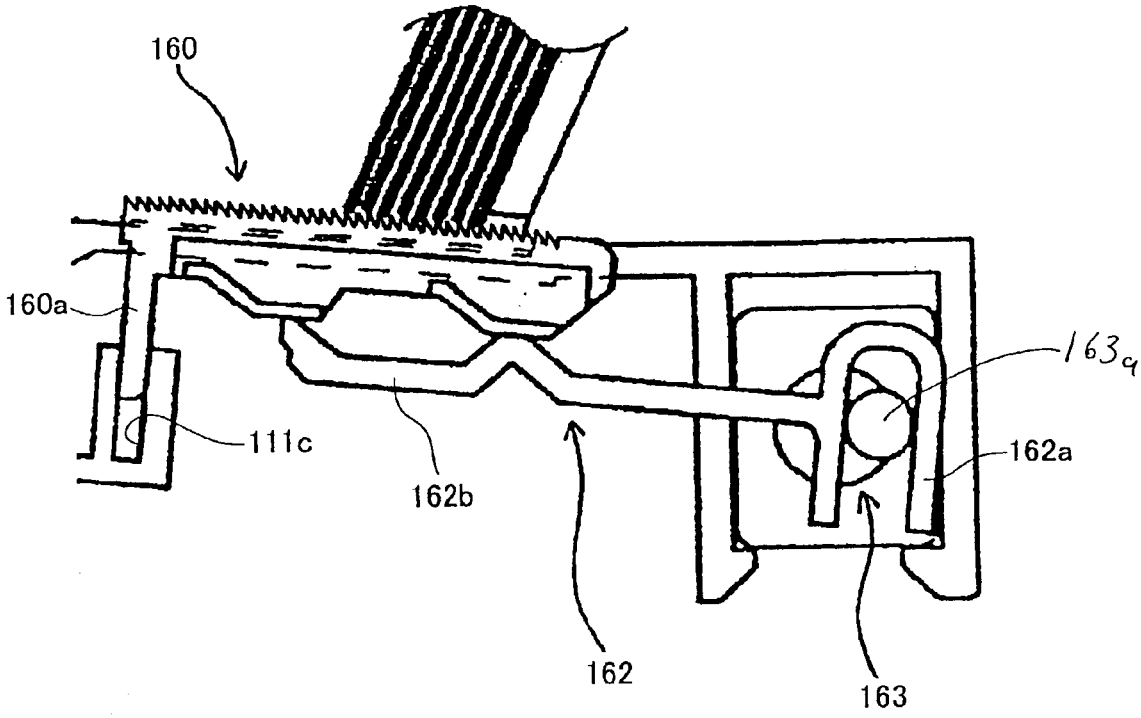
FIG. 22 is an enlarged view of FIG. 21B showing a high-friction member provided on the stopper member to prevent the sheets from slipping downstream.

Next, stopper members 160 according to the second embodiment will be described. The stopper members 160 are made from resin and are for retaining the stacked sheets P. As shown in FIG. 18, the stopper members 160 are disposed in one of two arrangement grooves 161 provided in the separation plate 115. The arrangement grooves 161 are open upward and extend in the guide direction A in FIGS. 17 and 19. The arrangement grooves 161 are provided symmetrically on either side of the extension of the linear sheet-supply force Q by the sheet feed roller 21. The stopper members 160 are capable of moving between a retracted position shown in FIG. 18 and a protruding position shown in FIG. 22. As shown in FIG. 22, the upper surface of each of the stopper members 160 is formed with a saw tooth configuration with ridges that extend parallel with the sheet-supporting surface 112. Each of the stopper members 160 has on its under surface a cam surface enabling the stopper members 160 to ascend and descend. While the stopper members 160 are in the retracted position, the upper surfaces of the stopper members 160 do not protrude above the upper surface of the separation plate 115. On the other hand, the upper surfaces of the stopper members 160 protrude above the upper surface of the separation plate 115 to support the lower edges of the stacked sheets P only when the stopper members 160 are in the protruding position.

Next, a stopper moving mechanism for moving the stopper members 160 between the protruding and retracted positions will be described. The stopper moving mechanism includes a rotation shaft 163 and link members 162. As shown in FIG. 19, the rotation shaft 163 is rotatably disposed in the upper back portion of the lower frame portion 111*a* of the frame 11. The end portions of the rotation shaft 163 extend through the right and left side wall plate 114 and are rotatably supported. The rotation shaft 163 is fixed to the cam gear 81 on the outer surface of the right-hand side wall plate 114. The cam gear 81 is connected to a driving mechanism shown FIGS. 20A, 20B, and 20C.

Figure 21A:
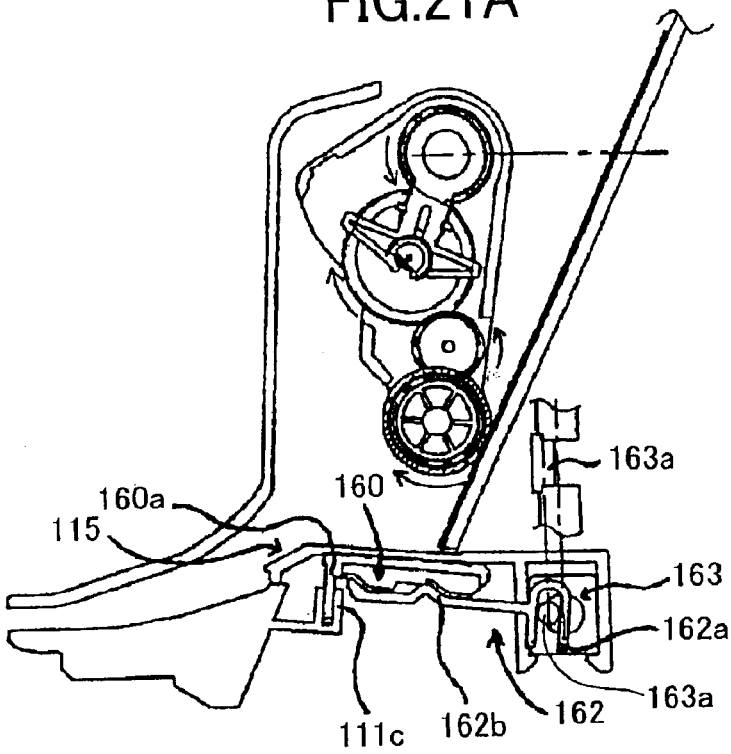
FIG. 21A shows a stopper moving mechanism of the sheet-supply device of the second embodiment, wherein the stopper members are moved into the retracted position.
Figure 21B:
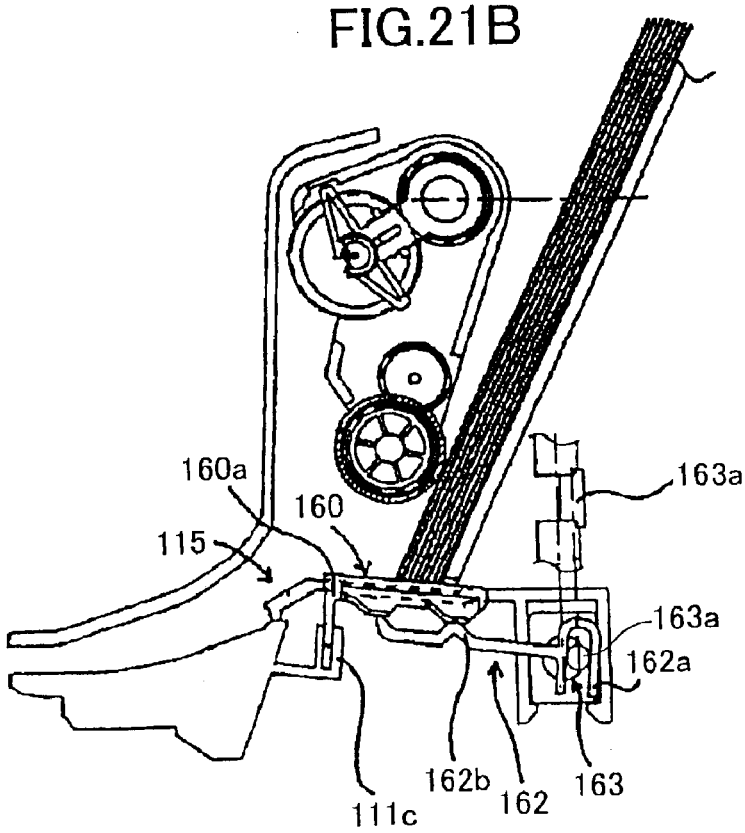
FIG. 21B shows the stopper moving mechanism of FIG. 21A, wherein the stopper members are moved into the protruding position.

As shown in FIGS. 21A, 21B, and 22, the rotation shaft 163 is formed with a cylindrical cams 163*a* at predetermined positions. The link members 162 are located in correspondence with a cam 163*a* and are adapted to convert the rotational motion of the cam 163*a* into linear vertical movement of the stopper members 160. Each of the link members 162 includes an integral inverted-U-shaped member 162*a* and an arm member 162*b*. The cams 163*a* are engaged in the inverted-U-shaped members 162*a*. The arm members 162*b* extend from the inverted-U-shaped members 162*a* and support the stopper members 160 from below.

Because the cam 163*a* are engaged in the inverted-U-shaped members 162*a*, the link members 162 reciprocate laterally as the rotation shaft 163 rotates. The upper surface of each arm member 162*b* is formed in a linear cam shape. The under surface of each of the stopper members 160 is formed with a cam shape that fits in the linear cam shape of the arm member 162*b*. As the link members 162 move linearly, the arm members 162*b* slide under the stopper members 160. When the arm members 162*b* are in their front most position as shown in FIG. 21A, then the cam surfaces of the arm members 162*b* and the stopper members 160 fit together so that the stopper members 160 retract downward. When the arm members 162*b* are in their rear most position as shown in FIG. 21B, then protruding portions of the cam surfaces of the arm members 162*b* and the stopper members 160 abut against each together so that the stopper members 160 protrude upward. The stopper members 160 each has a protrusion 160*a*, which is engaged with a groove 111*c* provided below the separation plate 115, so that the stopper members 160 do not move back and forth by the reciprocating movement of the link member 162.

Next, the driving mechanism shown FIGS. 20A, 20B, and 20C will be described. The driving mechanism includes the driving motor 80 and gears 90 through 97. The driving motor 80 is capable of forward and reverse rotation. A motor gear 80*a* is provided on the driving motor 80. A gear 97 is in meshing engagement with the motor gear 80*a*. A gear 96*a* is in meshing engagement with the gear 97 and rotates integrally with a gear 96*b*. A gear 92*a* is in meshing engagement with the gear 96*b* and rotates integrally with a gear 92*b*. A planetary gear 93 is rotatably provided on the distal end of an arm 98, which is pivotably fitted onto the center shaft 99 of a double gear 92, which includes the gears 92*a*, 92*b*. The planetary gear 93 is in meshing engagement with the gear 92*b*. A gear 91 is in meshing engagement with the gear 92*b*. A drive gear 90 is in meshing engagement with the gear 91. The gear 92*a* is also in meshing engagement with an intermediate gear 94, which is in meshing engagement with a gear 95. The cam gear 81 is in meshing engagement with the gear 95.

The intermediate gear 94 is located below the double gear 92, that is, at a position where it can mesh with the planetary gear 93 through movement of the arm 98. Further, a pin 100 is provided in the vicinity of the right upper portion of the gear 92*b*. The pin 100 abuts the arm 98 to regulate the range in which the arm 98 can move toward the gear 91 with the rotation of the gear 92*b*. Further, the cam gear 81 is provided with a cam 83 that rotates integrally with the cam gear 81. A sensor 82 having a switch portion 82*a* is disposed to the left of and below the cam 83. The switch portion 82*a* is abutted by the cam 83 as the cam gear 81 rotates and is disposed to the left of and below the cam 83 so that the sensor 82 can detect the ascent and descent of the stopper members 160 through turning ON (vertical orientation) and OFF (horizontal orientation) of the switch 82*a* by the cam 83. The CPU 50 controls the timing of forward and reverse rotation of the driving motor 80 based on this information.

FIG. 20B shows the condition of the driving mechanism during the sheet setting condition before sheets are supplied. At this time, the arm 98 pivotably fitted onto the center shaft 99 of the double gear 92 is in abutment with the gear 94. The driving motor 80 is at rest, so that the planetary gear 93 is at rest while in meshing engagement with the intermediate gear 94. Also, the cams 163*a* of the rotation shaft 163 are in their position farthest away from the stopper members 160, so that the cam surfaces of the stopper members 160 and link member 162 do not fit intimately together. As a result, the stopper members 160 are raised in their protruding position. At this time, the cam 83 of the cam gear 81 is at rest with the switch portion 82*a* of the sensor 82 turned ON, so that the CPU 50 realizes that the stopper members 160 is in the protruding position.

When a print signal is received from the CPU 50, then before sheet feed is started, the driving motor 80 (motor gear 80*a*) is rotated counterclockwise as shown in FIG. 20C. As a result, the gear 97 in meshing engagement with the motor gear 80*a* is rotated clockwise, whereby the gear 96*a* in meshing engagement with the gear 97 rotates counterclockwise. As a result, the gear 96*b* also rotates counterclockwise, and the gear 92*a* rotates clockwise. As the gear 92*a* rotates, the gear 92*b* rotating clockwise imparts counterclockwise torque to the planetary gear 93 in meshing engagement with therewith, whereby the intermediate gear 94 in meshing engagement with the planetary gear 93 rotates clockwise, the gear 95 rotates counterclockwise, and the cam gear 81 rotates clockwise. As a result, the cams 163*a* of the rotation shaft 163 move so as to approach the stopper members 160, and the linear cam of each link member 162 is brought into fit engagement with the cam on the back side of the corresponding stopper member 160, so that the stopper members 160 lower down into their retracted position.

When the cam 83 of the cam gear 81 rotates to the point where the switch portion 82*a* of the sensor 82 is turned OFF, the CPU 50 judges that the stopper members 160 has reached the retracted position, and switches the rotating direction of the driving motor 80. As shown in FIG. 20A, when the driving motor 80 (motor gear 80*a*) rotates clockwise, counterclockwise torque is imparted to the gear 97, whereby the gear 96*a* in meshing engagement with the gear 97 rotates clockwise. As a result, the gear 96*b* also rotates clockwise, and the gear 92*a* rotates counterclockwise. Then, the arm 98 pivots counterclockwise with the clockwise torque imparted on the planetary gear 93 by the gear 92*b*. Once the arm 9 abuts the pin 100, the planetary gear 93 rotates freely at the right-hand side of the gear 92*b*. Also, the torque of the gear 92*b* rotates the gear 91 clockwise, and the rotation of the gear 91 imparts counterclockwise torque on the driving gear 90. As a result, the sheet feed roller 21 rotates in the sheet feed direction to start sheet feed. At this time, the planetary gear 93 is on the right-hand side of the gear 92*b* and in a freely rotating state, so that the torque of the driving motor 80 is not transmitted to the intermediate gear 94. Thus, the gears 94 and 95 are at rest, so that the cam gear 81 remains at the position shown in FIG. 20C and the stopper members 160 remain in the retracted position.

Once sheet feed has been completed, and the apparatus returns to a non-sheet-feeding state, the driving motor 80 (the motor gear 80*a*) is driven to rotate counterclockwise as shown in FIG. 20B in accordance with a signal from the CPU 50. As a result, clockwise torque is imparted to the gear 97, and the gear 96*a* rotates counterclockwise, whereby the gear 96*b* also rotates in the same direction, and the gear 92*a* rotates clockwise. Then, due to the counterclockwise torque imparted to the planetary gear 93 by the gear 92*b* rotating in the same direction as the gear 92*a*, the arm 98 pivots clockwise, and the planetary gear 93 meshes with the intermediate gear 94. Then, the intermediate gear 94 rotates clockwise, and the cam gear 81 rotates clockwise by way of the gear 95, with the result that the stopper members 160 are raised up by action of the link member 162. When the cam 83 of the cam gear 81 turns the switch portion 82*a* of the sensor 82 to the ON position, the CPU 50 judges that the stopper members 160 are in their protruding position, and so stops drive of the driving motor 80. In this way, each time a single sheet-feeding operation is completed, the cam gear 81 is rotated until the cam 83 faces downward and the stopper 160 is brought into the protruding position. Even if a plurality of sheets are mounted on the sheet-supporting surface 12 at this time, there is no fear that the sheets will slip downstream. When a plurality of sheets are fed out in succession, then before a subsequent sheet is fed out, the gears rotate again as shown in FIG. 20C to lower the stopper members 160 into the retracted position immediately before the subsequent sheet is fed out. Therefore, a series of sheets can be fed out smoothly.

Next, the sheet separating action produced by the above construction will be described. A plurality of sheets P are placed beforehand in a stack on the sheet-supporting surface 112 of the sheet-supply device 110. The right and left side edges of the sheets P are guided and regulated by the right and left guide plates 113*a* and 113*b*, and the sheets P are arranged at the lateral center of the sheet-supporting surface 112 so as to be situated in the center line with respect to the width direction of the sheets P. In this condition, all the lower edges of the stacked sheets P abut the upper surfaces of the stopper members 160, but they do not abut the high-friction separation member 131 or the upper surface of the separation plate 115.

When, upon receiving a signal from the external control device of a personal computer, an external facsimile apparatus or the like, a printing command is issued from the CPU 50, the driving motor 80 is started to be driven, and the drive force is transmitted to the sheet feed roller 21 and the mechanism for raising and lowering the stopper members 160. At this time, the stopper members 160 are lowered into the retracted position to a level below the upper surface of the separation plate 115. As a result, the sheet stack is lowered until the lower edges of the stacked sheets P abut the high-friction separation member 131 and other upper surface portions of the separation plate 115. Next, the sheet feed roller 21 is rotated clockwise as viewed in FIG. 19 so that the uppermost sheet, which is pressed against by the sheet feed roller 21, is fed in the direction of the guide direction A of FIG. 19. At this time, the separating action of the high-friction separation member 131 insures that only the uppermost sheet of the stack is fed out.

Figure 23:
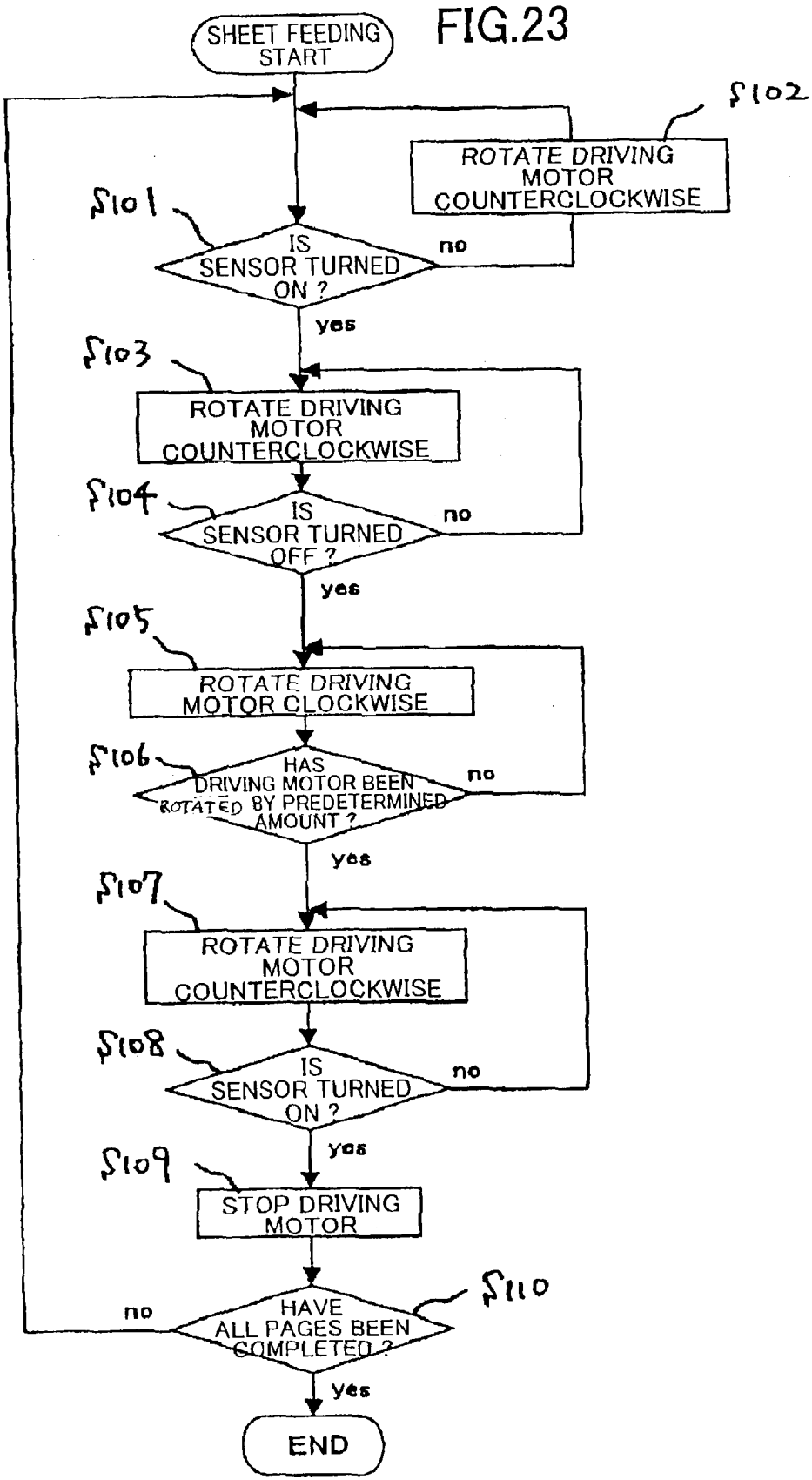
FIG. 23 is a flowchart representing control operations during a sheet feed operation of the image forming device of the second embodiment.

Next, control operation for raising and lowering the stopper members 160 will be described with reference to the flowchart of FIG. 23.

Before sheet feed is started, the driving mechanism is in a stand by state shown in FIG. 20B. When sheet feed is started, then the CPU 50 first judges whether or not the stopper members 160 are in the protruding position, that is, whether or not the sensor 82 is turned ON (step S101; hereinafter, the term "step" will be abbreviated to "S"). If not, (S101: NO), then the driving motor 80 is driven to rotate counterclockwise (S102). The program repeatedly performs S102 until the sensor 82 is turned ON. Once the sensor 82 is judged to be turned ON (S101: YES), the program advances to S103, whereupon the driving motor 80 is rotated counterclockwise a certain amount(S103).

Next, it is judged whether or not the sensor 82 is turned OFF as shown in FIG. 20C (S104). If not (S104:NO), then the program returns to S103 so that the driving motor 80 is driven to rotate a bit more. Once the sensor 82 is turned OFF, that is, the stopper members 160 are lowered below the high-friction separation member 131 of the separation plate 115 to reach the retracted position (S104: YES), then the CPU 50 switches the rotating direction of the driving motor 80, so that the driving motor 80 rotates clockwise as shown in FIG. 20A (S105).

Next, after S105, the CPU 50 judges whether or not the driving motor 80 has been rotated by a predetermined amount (S106) When the CPU 50 judges that the motor has not been rotated by the predetermined amount yet (S106: NO), the procedure returns to step S105, where the clockwise rotation of the driving motor 80 is continued. This predetermined amount is an amount sufficient for transporting the sheet from the to a pair of transport rollers (not shown) disposed downstream in the sheet transporting portion 46. At this point the separating operation is completed. Therefore, once it is determined that the motor has been rotated by the predetermined amount (S106: YES), the CPU 50 switches the rotating direction of the driving motor 80 to raise the stopper members 160 into the protruding position (S107).

Then it is judged whether or not the sensor 82 is turned ON as shown in FIG. 20B (S108), that is, whether the stopper members 160 protrude above the high-friction separation member 131 of the separation plate 115 into the protruding position. If so (S108: YES), the CPU 50 stops the rotation of the driving motor 80 (S109). When the sensor 82 is not turned on yet (S108: NO), the procedure returns to step S107, where the counterclockwise rotation of the driving motor 82 is continued.

Finally, in step S110, the CPU 50 makes a judgment as to whether all the pages on which printing is to be performed have been fed out or not. If not (S110: NO), the procedure returns to step S101, where the above-described steps are repeated. When it is determined in step S110 that all the pages have been fed (S110: YES), the sheet feed operation is completed.

In the second embodiment, no components that are easily subject to fatigue, such as springs, are used to link the drive force of the motor to the ascending and descending motion of the stopper members 160. The linking operation is performed mainly by gears. Therefore, maintenance is simpler and less space is required. Further, since the number of parts is small, it is possible to achieve a reduction in cost. Further, the vertical movement of the stopper members 160 between the protruding and retracted positions involves a smaller movement amount than the pivotal movement of the stopper members 60 of the first embodiment. Therefore, so there is no fear of damaging the lower edges of the sheets P.

Because the stopper members 160 are raised-up above the high-friction separation member 131, the lower edges of the sheets P stacked on the sheet-supporting surface 112 do not directly abut the upper surface of the separation plate 115. Therefore, the sheets P will not slide off the sheet-supporting surface 112. Further, the upper surface of both of the stopper members 160 is maintained in parallel with the high-friction separation member 131 while the stopper members 160 are raised up and down. Therefore, the stopper members 160 need only move vertically (up and down) by a slight distance. As a result, the stopper members 160 will not shake the sheets P when they abut against the sheets P. Further, the sheet lower edges will not be damaged by the movement of the stopper members 160.

Further, the upper surface of the stopper members 160 has a high friction coefficient, so that friction is developed against the lower edges of the sheets P on the stopper members 160. This insures that the sheets will not slip off the sheet-supporting surface 112.

Further, immediately before sheets are fed out, the operation mechanism for moving the stopper members 160 retracts the stopper members 160 out from abutment with the lower edges of the sheets P placed on the sheet-supporting surface 112. Then, after the lower edges of the sent-out sheets have passed the stopper members 160, the operation mechanism moves the stopper members 160 back into abutment with the lower edges of the sheets P remaining on the sheet-supporting surface 112. The stopper members 160 do not interfere with sheet feed because they are lowered immediately before the start of sheet feed. Therefore, sheets can be fed out smoothly. Further, the stopper members 160 are raised back up again after the lower edge of a fed out sheet passes by the stopper members 160. Therefore, the remaining sheets P in the stack will be stably maintained on the sheet-supporting surface 112. Specifically, there is no fear of the sheets slipping off the sheet-supporting surface 112 during the non-feeding state so that sheets are set in an optimal condition on the sheet supporting surface.

Further, the operation mechanism for moving the stopper members 160 receives drive force from the rotation shaft 163 that is rotated by the drive force of the driving motor 80 that drives the sheet-supply device 110. The operation mechanism also includes the cam 163*a* provided on the rotation shaft 163 and the link member 162 for converting the pivoting motion of the cam 163*a* to the ascending and descending motion of the stopper members 160. With this configuration, there is no need to provide a separate motor for raising and lowering the stopper members, 160. Therefore, the force of the driving motor 80 can be used without any waste.

Further, the link member 162 includes the U-shaped member 162*a* and the arm member 162*b*. The U-shaped member 162*a* converts the rotating motion from the cam 163*a* to a linear reciprocating motion. The arm member 162*b* extends in the direction of the reciprocating motion from the U-shaped member 162*a* and is formed in a linear cam configuration. In addition, the stopper members 160 are supported on the arm member 162*b* and has a cam surface opposed to the arm member 162*b*. The stopper members 160 is raised and lowered through the reciprocating motion of the link member 162. This requires less energy than the pivoting movement of the first embodiment. Further, the weight of the plurality of sheets P can be sustained in a stable manner.

Further, the length of the portion of each stopper members 160 abutted by the sheet lower edges is the same as or larger than the thickness of the abutting portion of the stack of the maximum number of sheets P that can be stacked on the sheet-supporting surface 112, so that when a plurality of sheets P are placed, there is no danger of the sheet lower edges slipping off the stopper members 160 and sliding downstream. Therefore, the set state of the sheets P can be properly maintained.

Further, the high-friction separation member 131 has a higher friction coefficient than the friction coefficient of the upper surface of the separation plate 115. Because the stopper members 160 are provided near the high-friction separation member 131, the stopper members 160 can properly prevent the lower edges of the stacked sheets P from abutting the high-friction separation member 131, even if the sheets P sag downward under their own weight. The same can be said for the stopper members 60 of the first embodiment.

Further, because the stopper members 160 are arranged in the width direction of the sheets P with the high-friction separation member 131 therebetween, the sheets can be maintained in an even more stable set state. The same can be said for the configuration of the first embodiment.

Further, since with an image forming device equipped with the above-described sheet-supply device it is possible to reliably prevent double feeding of sheets P by the sheet-supply device, it is possible to reliably form a predetermined image on each of the sheets P fed one by one from the sheet stack placed in the sheet-supply device in a stable attitude.

While some exemplary embodiments of this invention have been described in detail, those skilled in the art will recognize that there are many possible modifications and variations which may be made in these exemplary embodiments while yet retaining many of the novel features and advantages of the invention.

For example, the second embodiment described the same driving motor 80 for both driving rotation of the sheet feed roller 21 and vertical movement of the stopper members 160. However, a separate motor can be provided for driving movement of the stopper member. In this case, the additional motor would lower the stopper members 160 to the retracted position where the stopper members 160 do not abut the lower edges of the stacked sheets P immediately before the sheet-feeding start. Then, raise the stopper members 160 immediately after the lower edges of the fed sheets have passed the stopper members 160 so that the lower edges of the remaining stacked sheets P are properly supported. Further, in correspondence with this, it is also possible to change the construction and arrangement of the gear chain for transmitting the drive force of the driving motors to the sheet feed roller 21 or the stopper members 160. This makes it possible to prevent double feeding due to friction between the sheet being fed and the sheet directly under the same, making it possible to attain a more effective separation even during sheet feed.

Figure 24A:
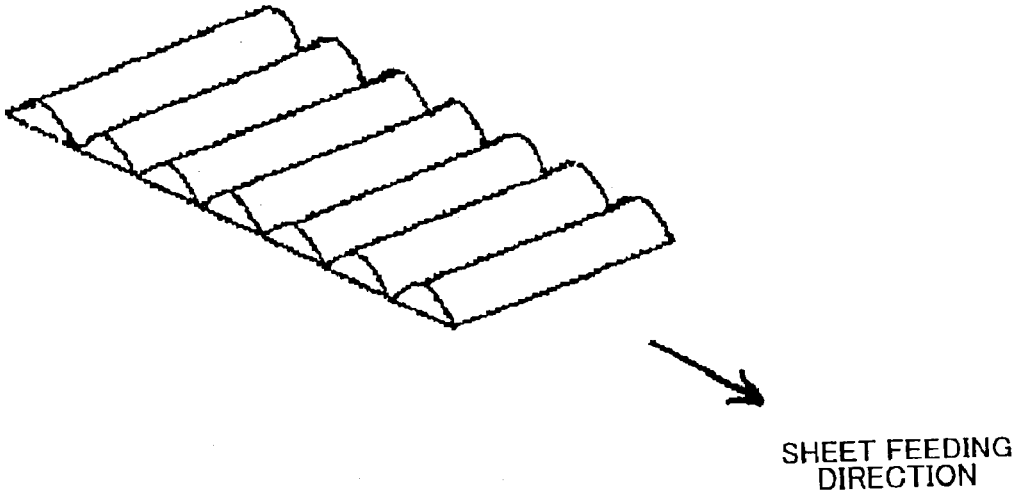
FIG. 24A is a perspective view showing a modification of the high-friction member of the stopper members.
Figure 24B:
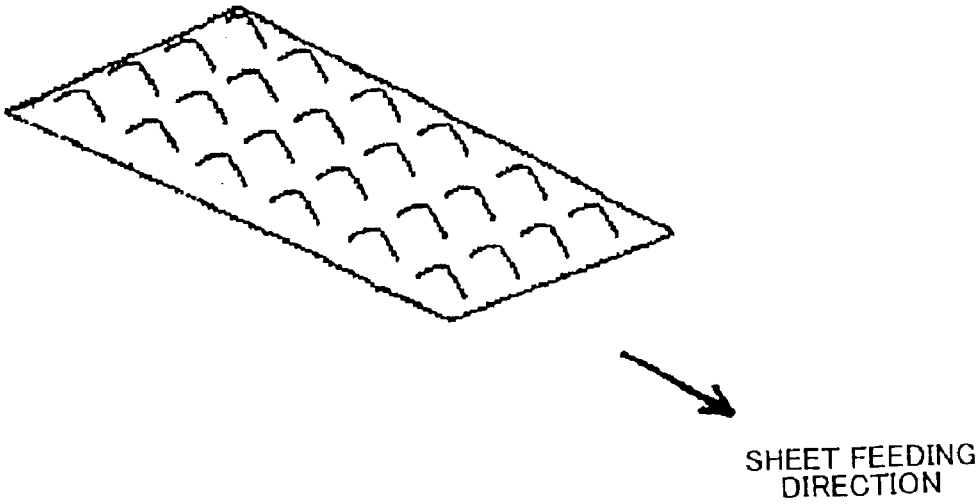
FIG. 24B is a perspective view showing another modification of the high-friction member of the stopper members.

The stopper members 60, 160 of the first and second embodiments have a saw tooth surface where they abut against the sheets P. However, the sheet abutting surface of the stopper members can be formed in other corrugated shapes, such as the smoother, wavelike corrugated surface shown in FIG. 24A. It should be noted that with both the saw-toothed type and the wave-like type corrugated surface, the corrugated surface includes alternating grooves and ridges, wherein the ridges extend parallel to the sheet-supporting surface. Alternately, the sheet abutting surface of the stopper members can be formed with a plurality of protrusions arranged parallel to the sheet-supporting surface as shown in FIG. 24B. In this construction, the lower edges of the sheets P are engaged with the plurality of protrusions formed on the stopper members 160, so that the sheets P are even more effectively prevented from sliding off the sheet-supporting surface 112. As another option, the stopper members can be formed with a sheet abutting surface that has a high friction coefficient.

Further, when, as described above, the surface of the stopper members 160 has a saw tooth or wave-like configuration or a plurality of protrusions, the movement of the stacked sheets P in the width direction (to the right and left) is facilitated when the stopper members 160 are formed of a material having slidability, and the alignment of the side ends of the sheets P by the guide plates 113*a* and 113*b* is facilitated.

While in the second embodiment the rotation shaft 163 and the link member 162 are used to raise and lower the stopper members 160, this construction is not necessarily required. Any mechanism will serve the purpose as long as it is capable of raising and lowering the stopper members 160.

Further, it is only necessary for the length of the portion of the stopper members 160 abutted by the lower edges of the sheets P to be one which enables the stacked sheets P to be retained reliably. The length may be the same as or larger than the thickness of the portion of the stack of the maximum number of sheets that can be stacked on the sheet-supporting surface 112 which abuts the stopper members 160.

In the above-described embodiments, the pair of left and right guide plates 13*a*, 13*a* guide the sheets P so that the widthwise center of the lower edge the sheets P abuts against the high-friction separation member 31, regardless of the horizontal size (width) of the sheets P. However, the exact widthwise center of the lower edge need not abut against the high-friction separation member 31. The same effects can be achieved as long as a position near the center of the lower edge abuts against the high-friction separation member 31, even if there is some shift to the left or right. Accordingly, the present invention can be used in a sheet-supply device for supplying sheets P using either the left or right edge of the sheet P as a reference. Here, it is also possible for one of the high-friction separation member 31, 131 to abut the lower edge of the central portion with respect to the width direction of the sheets P brought nearer to it.

Of course, the separation operation will operate smoothly as long as the high-friction separation member 31 is near the linear sheet supply force Q of the sheet supply roller 21, even if the high-friction separation member 31 is slightly shifted from the extension of the linear sheet-supply force Q.

Further, while in the above embodiments a pair of stoppers 60, 160 are arranged symmetrically close to the high-friction separation member 31, 131 provided on the sheet separation section, this should not be construed restrictively. They may be situated apart from the high-friction separation member 31, 131 as long as they can reliably support the lower edges of the sheets P. Further, it is not necessary for them to be arranged symmetrically. Further, it goes without saying that it is possible to use more stopper members with the separation members therebetween.

What is claimed is:

1. A sheet-supply device for supplying sheets from a stack of sheets one at a time in a guide direction, the sheet-supply device comprising:

a sheet supporting member with a sheet-supporting surface that supports the stack of sheets;

a sheet feed unit applying a force to a sheet in the stack to move the sheet in a sheet feed direction;

a guide member disposed at a downstream side of the sheet supporting member with respect to the sheet feed direction, the guide member having a guide surface that guides the sheet in the guide direction as the sheet slides across the guide surface, the guide surface generating a resistance to sliding movement of sheets;

a stopper member disposed in the guide member and having a stack-slippage prevention surface capable of imparting a larger resistance to sliding movement of sheets than the guide surface, the stopper member being movable between:

a protruding position wherein the stack-slippage prevention surface of the stopper member protrudes away from the guide surface in a direction substantially opposite from the sheet feed direction to a position into abutment with the stack of sheets to impart the larger resistance on the stack of sheets; and a retracted position wherein the stack-slippage prevention surface of the stopper member is retracted away from the guide surface in substantially the sheet feed direction to a position out of contact with the stack of sheets so that the stack-slippage prevention surface does not impart the larger resistance on the stack of sheets; and a stopper moving mechanism that selectively moves the stopper member between the protruding position and the retracted position.

2. A sheet-supply device as claimed in claim 1, wherein the stopper moving mechanism is ganged with the stopper member to move the stopper member between the protruding position and the retracted position in association with movement of the stopper moving mechanism.

3. A sheet-supply device as claimed in claim 2, wherein the stopper moving mechanism includes a manual lever and a linking mechanism, the linking mechanism interlocking movement of the manual lever and the stopper member.

4. A sheet-supply device as claimed in claim 3, wherein the stopper moving mechanism further includes an auto reset mechanism that automatically moves the stopper members into the retracted position directly before the sheet feed unit begins to apply the force to move the sheet in the sheet feed direction.

5. A sheet-supply device as claimed in claim 1, wherein the stack-slippage prevention surface of the stopper member includes a high-friction member that contacts the stack of sheets while the stopper member is in the protruding position, the stack-slippage prevention surface imparting the larger resistance on the stack of sheets by the high-friction member.

6. A sheet-supply device as claimed in claim 1, wherein the sheet-supporting surface of the sheet supporting member and the guide surface of the guide member each substantially define imaginary planes that intersect at an imaginary intersection line, further comprising a pivot shaft disposed in the vicinity of the imaginary intersection line, the stopper member being pivotably mounted on the pivot shaft so as to be pivotable between the protruding position and the retracted position.

7. A sheet-supply device as claimed in claim 1, wherein the stack-slippage prevention surface imparts the larger resistance on the stack of sheets by forming an acute angle with the sheet-supporting surface of the sheet supporting member while the stopper member is in the protruding position.

8. A sheet-supply device as claimed in claim 1, wherein the stopper member includes a pair of stopper members, the guide surface including:

a fixed separation plate provided at a widthwise center of the sheet supporting member, the fixed separation plate having a high-friction separation member that separates the sheet moved in the sheet feed direction by the sheet feed unit from the stack of sheets; and a pair of movable separation plates positioned laterally beside the fixed separation plate, the pair of first movable separation plates being pivotally movably supported to be pivotally movable out of the guide direction and having a pair of first guide surfaces, each of the pair of stopper members being disposed at a corresponding one of the pair first guide surfaces.

9. A sheet-supply device as claimed in claim 1, wherein the stopper moving mechanism includes a parallel posture maintenance mechanism that maintains the stack-slippage prevention surface of the stopper member in a substantially parallel condition with the guide surface of the guide member while moving the stopper member between the protruding position and the retracted position.

10. A sheet-supply device as claimed in claim 9, wherein the sheet feed unit includes a drive motor that generates rotational movement, the parallel posture maintenance mechanism of the stopper moving mechanism including:

a rotation shaft that rotates by rotational movement from the drive motor of the sheet feed unit;

a cam member that rotates with rotation of the rotational shaft; and a link member that converts rotation of the cam member into reciprocal linear movement that moves the stopper member between the protruding position and the retracted position with the stack-slippage prevention surface of the stopper member in the substantially parallel condition.

11. A sheet-supply device as claimed in claim 10, wherein the stopper member includes a cam surface, the link member of the parallel posture maintenance mechanism including:

a conversion section that converts the rotational movement of the cam mechanism into the reciprocal linear movement; and an arm section extending in the direction of the reciprocal linear movement and formed with a linear cam surface, the linear cam surface contacting the cam surface of the stopper member and supporting the stopper member through contact with the cam surface, the linear cam surface and the cam surface interacting during the reciprocal linear movement to move the stopper member between the protruding position and the retracted position.

12. A sheet-supply device as claimed in claim 1, wherein the sheet-supporting surface of the sheet supporting member and the guide surface of the guide member each substantially define imaginary planes that intersect at an imaginary intersection line, the stack-slippage prevention surface of the stopper member is formed in a corrugated surface with alternating grooves and ridges, the ridges extending substantially parallel with the imaginary intersection line.

13. A sheet-supply device as claimed in claim 1, wherein the sheet-supporting surface of the sheet supporting member and the guide surface of the guide member each substantially define imaginary planes that intersect at an imaginary intersection line, the stack-slippage prevention surface of the stopper member being formed with a plurality of protrusions aligned substantially parallel with the imaginary intersection line.

14. A sheet-supply device as claimed in claim 1, wherein the stopper moving mechanism moves the stopper member into the retracted position out of contact with the sheets in the stack of sheets immediately before the sheet feed unit starts applying the force to the sheet in the stack to move the sheet in the sheet feed direction and, after a downstream edge, with respect to the sheet feed direction, of the sheet fed by the sheet feed unit passes by the stopper member, moves the stopper member into the protruding position so that the stopper member abuts sheets remaining in the stack of sheets.

15. A sheet-supply device as claimed in claim 1, wherein the stack-slippage prevention surface of the stopper member has a length with respect to the guide direction while the stopper member is in the retracted position, the sheet-supporting surface of the sheet supporting member being capable of supporting a maximum number of sheets, the maximum number of sheets having a thickness at a position that abuts against the stack-slippage prevention surface of the stopper member, the length of the stack-slippage prevention surface of the stopper member being the same length as the thickness of the maximum number of sheets.

16. A sheet-supply device as claimed in claim 1, wherein the stack-slippage prevention surface of the stopper member has a length with respect to the guide direction while the stopper member is in the retracted position, the sheet-supporting surface of the sheet supporting member being capable of supporting a maximum number of sheets, the maximum number of sheets having a thickness at a position that abuts against the stack-slippage prevention surface of the stopper member, the length of the stack-slippage prevention surface of the stopper member being the longer than the thickness of the maximum number of sheets.

17. A sheet-supply device as claimed in claim 1, wherein the guide member further includes a high-friction member disposed at the guide surface, the high-friction member having a higher friction coefficient than the guide surface, the stopper member being disposed near the high-friction member.

18. A sheet-supply device as claimed in claim 1, further comprising at least one other stopper member, the stopper member and the at least one other stopper member being aligned with the high-friction member interposed therebetween.

19. An image forming device comprising:

a sheet-supply device for supplying sheets from a stack of sheets one at a time in a guide direction, the sheet-supply device including:

a sheet supporting member with a sheet-supporting surface that supports the stack of sheets;

a sheet feed unit applying a force to a sheet in the stack to move the sheet in a sheet feed direction;

a guide member disposed at a downstream side of the sheet supporting member with respect to the sheet feed direction, the guide member having a guide surface that guides the sheet in the guide direction as the sheet slides across the guide surface, the guide surface generating a resistance to sliding movement of sheets;

a stopper member disposed in the guide member and having a stack-slippage prevention surface capable of imparting a larger resistance to sliding movement of sheets than the guide surface, the stopper member being movable between:

a protruding position wherein the stack-slippage prevention surface of the stopper member protrudes away from the guide surface in a direction substantially opposite from the sheet feed direction to a position into abutment with the stack of sheets to impart the larger resistance on the stack of sheets; and a retracted position wherein the stack-slippage prevention surface of the stopper member is retracted away from the guide surface in substantially the sheet feed direction to a position out of contact with the stack of sheets so that the stack-slippage prevention surface does not impart the larger resistance on the stack of sheets; and a stopper moving mechanism that selectively moves the stopper member between the protruding position and the retracted position; and an image forming portion disposed downstream from the sheet-supply device in the guide direction, the image forming portion forming images on sheets supplied by the sheet-supply device.

* * * * *